US012714921B2

(12) United States Patent
Spackman et al.

(10) Patent No.: US 12,714,921 B2
(45) Date of Patent: Aug. 25, 2026

(54) GOLF CLUB HEADS WITH RESILIENT MEMBERS

(71) Applicant: KARSTEN MANUFACTURING CORPORATION, Phoenix, AZ (US)

(72) Inventors: Clayson C. Spackman, Scottsdale, AZ (US); Eric J. Morales, Laveen, AZ (US); Joshua A. Degerness, Scottsdale, AZ (US); Cory S. Bacon, Scottsdale, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 216 days.

(21) Appl. No.: 18/472,164

(22) Filed: Sep. 21, 2023

(65) Prior Publication Data

US 2024/0091605 A1 Mar. 21, 2024

Related U.S. Application Data

(60) Provisional application No. 63/376,586, filed on Sep. 21, 2022.

(51) Int. Cl.
*A63B 53/04* (2015.01)

(52) U.S. Cl.
CPC ..... *A63B 53/0466* (2013.01); *A63B 53/0408* (2020.08); *A63B 53/0416* (2020.08); *A63B 2053/0495* (2013.01)

(58) Field of Classification Search
CPC ..... A63B 53/0466; A63B 53/045; A63B 2053/0495
See application file for complete search history.

(56) References Cited

U.S. PATENT DOCUMENTS

| | | | | |
|---|---|---|---|---|
| 4,511,145 | A | 4/1985 | Schmidt | |
| 4,602,787 | A | 7/1986 | Sugioka | |
| 5,000,454 | A | 3/1991 | Soda | |
| 5,141,230 | A | 8/1992 | Antonious | |
| 5,346,217 | A * | 9/1994 | Tsuchiya | A63B 53/04 473/345 |
| 5,451,058 | A | 9/1995 | Price | |
| 5,839,975 | A | 11/1998 | Lundberg | |

(Continued)

FOREIGN PATENT DOCUMENTS

| | | |
|---|---|---|
| CN | 2661252 | 12/2004 |
| CN | 108015223 | 5/2018 |

(Continued)

OTHER PUBLICATIONS

Int'l Search Report and Written Opinion from corresponding PCT appl. No. PCT/US2020/050769, filed on Sep. 14, 2020.

*Primary Examiner* — Raeann Gorden

(57) ABSTRACT

A golf club head includes a resilient member extending from a sole of the club head to the crown. The resilient member has a convex, arcuate shape relative to a strike face of the club. The resilient member has a rest state prior to impact with a golf ball, in which the resilient member defines a first chord length, and a deflected state during impact with a golf ball, in which the resilient member defines a second chord length that is greater than the first chord length. The resilient member improves impact response of the strike face to allow strike face thickness to be reduced while maintaining durability of the golf club head.

16 Claims, 16 Drawing Sheets

(56) References Cited

U.S. PATENT DOCUMENTS

| | | | |
|---|---|---|---|
| 5,941,782 | A | 8/1999 | Cook |
| 6,299,547 | B1 | 10/2001 | Kosmatka |
| 6,309,311 | B1 | 10/2001 | Lu |
| 6,383,090 | B1 | 5/2002 | O'Doherty et al. |
| 6,695,715 | B1 | 2/2004 | Chikaraishi |
| 6,835,145 | B2 | 12/2004 | Tsurumaki |
| 6,852,038 | B2 | 2/2005 | Yabu |
| 6,878,073 | B2 | 4/2005 | Takeda |
| 6,964,617 | B2 | 11/2005 | Williams |
| 6,991,559 | B2 | 1/2006 | Yabu |
| 7,056,228 | B2 | 6/2006 | Beach |
| 7,056,229 | B2 | 6/2006 | Chen |
| 7,247,103 | B2 | 7/2007 | Beach |
| 7,351,161 | B2 | 4/2008 | Beach |
| 7,445,563 | B1 | 11/2008 | Werner |
| 7,445,564 | B2 | 11/2008 | Kusumoto |
| 7,749,104 | B2 | 7/2010 | Brekke |
| 7,775,906 | B2 | 8/2010 | Kusumoto |
| 7,828,676 | B2 | 11/2010 | Wada |
| 7,854,666 | B2 | 12/2010 | Horacek |
| 7,914,393 | B2 | 3/2011 | Hirsch |
| 7,998,000 | B2 | 8/2011 | Brekke |
| 8,033,932 | B2 | 10/2011 | Wada |
| 8,323,121 | B2 | 12/2012 | Wada |
| 8,357,056 | B2 | 1/2013 | Horacek |
| 8,523,702 | B2 | 9/2013 | Thomas |
| 8,540,587 | B2 | 9/2013 | Hirsch |
| 8,591,352 | B2 | 11/2013 | Hirano |
| 8,608,585 | B2 | 12/2013 | Stites |
| 8,727,910 | B2 | 5/2014 | Nakano |
| 8,758,164 | B2 | 6/2014 | Breier |
| 8,827,834 | B2 | 9/2014 | Horacek |
| 8,956,244 | B1 | 2/2015 | Westrum |
| 9,333,390 | B1 | 5/2016 | Manwaring |
| 9,345,936 | B1 | 5/2016 | Westrum |
| 9,457,241 | B2 | 10/2016 | Hebreo |
| 9,486,677 | B1 | 11/2016 | Seluga |
| 9,597,558 | B1 | 3/2017 | Seluga |
| 9,597,561 | B1 | 3/2017 | Seluga |
| 9,623,291 | B2 | 4/2017 | Greensmith |
| 9,717,962 | B1 | 8/2017 | Seluga |
| 9,757,629 | B2 | 9/2017 | Seluga |
| 9,776,054 | B2 | 10/2017 | Horacek |
| 9,776,058 | B2 | 10/2017 | Seluga |
| 9,795,840 | B2 | 10/2017 | Greensmith |
| 9,814,947 | B1 | 11/2017 | Seluga |
| 9,814,954 | B2 | 11/2017 | Westrum |
| 9,821,199 | B1 | 11/2017 | Seluga |
| 9,901,794 | B2 | 2/2018 | Beno |
| 9,908,019 | B1 | 3/2018 | Seluga |
| 9,931,549 | B1 | 4/2018 | Seluga |
| 9,931,550 | B1 | 4/2018 | Seluga |
| 9,943,733 | B2 | 4/2018 | Franklin |
| 9,993,704 | B2 | 6/2018 | Hebreo |
| 10,065,085 | B2 | 9/2018 | Seluga |
| 10,076,694 | B2 | 9/2018 | Galvan |
| 10,092,797 | B2 | 10/2018 | Greensmith |
| 10,130,849 | B2 | 11/2018 | Franklin |
| 10,213,661 | B2 | 2/2019 | Seluga |
| 10,238,933 | B1 | 3/2019 | Seluga |
| 10,258,846 | B1 | 4/2019 | Nunez |
| 10,322,319 | B2 | 6/2019 | Del Rosario |
| 10,335,647 | B2 | 7/2019 | Seluga |
| 10,369,435 | B1 | 8/2019 | Myers |
| 10,406,408 | B1 | 9/2019 | Seluga |
| 10,463,925 | B2 | 11/2019 | Greensmith |
| 10,507,366 | B2 | 12/2019 | Hebreo |
| 10,518,146 | B2 | 12/2019 | Myers |
| 10,532,258 | B2 | 1/2020 | Seluga |
| 10,569,142 | B2 | 2/2020 | Del Rosario |
| 10,589,154 | B2 | 3/2020 | Seluga |
| 10,617,920 | B2 | 4/2020 | Nunez |
| 10,653,927 | B2 | 5/2020 | Murphy |
| 10,716,980 | B2 | 7/2020 | Myers |
| 10,850,169 | B1 | 12/2020 | Day |
| 10,888,742 | B2 | 1/2021 | Greensmith |
| 10,912,970 | B1 | 2/2021 | Hanhart |
| 10,981,040 | B2 | 4/2021 | Nunez |
| 11,027,176 | B2 | 6/2021 | Del Rosario |
| 11,135,614 | B1 | 10/2021 | Reed |
| 11,266,885 | B2 | 3/2022 | Greensmith |
| 2003/0190975 | A1* | 10/2003 | Fagot ..... A63B 53/047 473/346 |
| 2005/0192119 | A1* | 9/2005 | Beach ..... A63B 53/0466 473/409 |
| 2005/0197207 | A1* | 9/2005 | Chen ..... A63B 53/0466 473/345 |
| 2007/0021234 | A1 | 1/2007 | Tsurumaki |
| 2007/0275792 | A1 | 11/2007 | Horacek |
| 2020/0023242 | A1 | 1/2020 | Hsiao |
| 2021/0051102 | A1 | 2/2021 | Dong |
| 2021/0070242 | A1 | 3/2021 | Kang |
| 2021/0162273 | A1 | 6/2021 | Greensmith |
| 2021/0236891 | A1 | 8/2021 | Nunez |
| 2021/0339093 | A1 | 11/2021 | Seluga |
| 2021/0362181 | A1 | 11/2021 | Reed |

FOREIGN PATENT DOCUMENTS

| | | |
|---|---|---|
| GB | 2547800 | 8/2017 |
| GB | 2558011 | 7/2018 |
| GB | 2559425 | 8/2018 |
| GB | 2559487 | 8/2018 |
| JP | 05269224 | 10/1993 |
| JP | 2717759 | 9/1994 |
| JP | 4001970 | 10/1998 |
| JP | 4009359 | 10/1999 |
| JP | 2006192110 | 7/2006 |
| JP | 4566936 | 9/2007 |
| JP | 2007267777 | 10/2007 |
| JP | 2007275547 | 10/2007 |
| JP | 2008086351 | 4/2008 |
| JP | 4616912 | 3/2009 |
| JP | 2009233266 | 10/2009 |
| JP | 5256224 | 11/2010 |
| JP | 2017012743 | 1/2017 |
| JP | 2019084325 | 6/2019 |
| JP | 7137741 | 9/2022 |

* cited by examiner

GOLF CLUB HEADS WITH RESILIENT MEMBERS

CROSS REFERENCE PRIORITIES

This claims the benefit of U.S. Provisional Application No. 63/376,586, filed Sep. 21, 2022, all of which is incorporated herein by reference.

FIELD OF INVENTION

This disclosure generally relates to golf equipment, and more particularly, to wood-type golf club heads.

BACKGROUND

Mass properties of a golf club head can be adjusted to improve one or more performance characteristics. For example, center of gravity location, moment of inertia values, and variable face configurations can be adjusted to improve forgiveness, ball speed, ball trajectory, or other performance characteristics of the golf club head. The United States Golf Association (USGA) have implemented rules that restrict certain performance characteristics of clubs.

Some club faces that would otherwise comply with these rules fail due to the presence of discrete areas of excessive impact response, informally known as "hot spots." A test impact with a hot spot may result in an impact response that causes the club to be deemed not to conform. Therefore, there is a need in the art for a wood-type golf club head having a normalized impact response across the entire face of the club.

DETAILED DESCRIPTION

Figure 1:
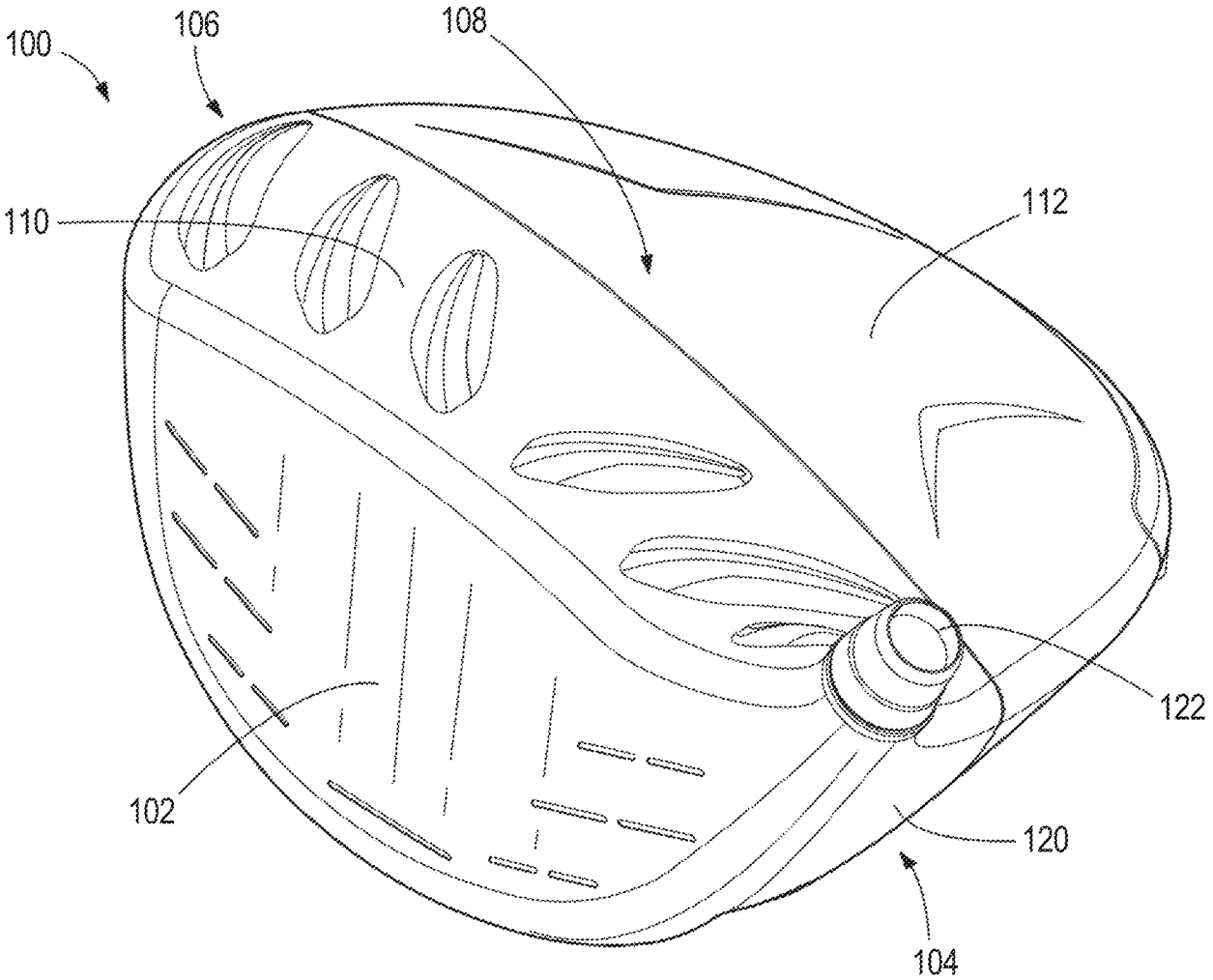
FIG. 1 illustrates a top perspective view of a wood-type club head.

Described herein are various embodiments of wood-type golf club heads (e.g., drivers, fairway woods, or hybrids also referred to as "the club head") comprising a resilient member to provide a strike face that is normalized for CT consistently throughout the strike face. The club head comprises a strike face secured to a body to define an interior cavity. The strike face can be formed from a metal material or a composite material, and the body can be formed from a metal or composite material. The body can be formed separately from a composite portion. The composite portion can form all or a portion of the crown, the sole, or both the crown and the sole. The club head can be an all-metal construction or multi-material construction. The club head comprises a resilient member within the internal cavity.

During high energy collisions, for example impact of the strike face with a golf ball, the resilient member acts as a spring. The resilient member has a rest state, a transition state, and a maximum deflected state. During the transition state, the resilient member absorbs energy from the face plate via the golf ball to assume a maximum deflected state. The resilient member subsequently increases the distance of the crown and sole allowing the strike face to freely flex.

The resilient member also acts as a stiffener during low-energy collisions, such as collisions less than 1 joule, 5 joules or 10 joules. Specifically, the golf club head deflects less in response to low-energy collisions, and the resilient member further reduces deflection under such conditions.

Definitions

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the apparatus, methods, and/or articles of manufacture described herein are, for example, capable of operation in other orientations than those illustrated or otherwise described herein.

As defined herein, "spline method" refers to a method to determine the location where the curvature of a surface changes. For example, the spline method can be used to determine where the surface curvature deviates from a bulge and roll curvature of the striking surface of a golf club head. The spline method can be implemented by imposing a spline onto the curved surface with an interval such that the spline indicates where a significant change in curvature begins.

The terms "loft" or "loft angle" of a golf club, as described herein, refers to the angle formed between the strike face and the shaft, as measured by any suitable loft and lie machine.

"Driver golf club heads" as used herein comprise a loft angle less than approximately 16 degrees, less than approximately 15 degrees, less than approximately 14 degrees, less than approximately 13 degrees, less than approximately 12 degrees, less than approximately 11 degrees, or less than approximately 10 degrees. Further, in many embodiments, "driver golf club heads" as used herein comprises a volume greater than approximately 400 cc, greater than approximately 425 cc, greater than approximately 445 cc, greater than approximately 450 cc, greater than approximately 455 cc, greater than approximately 460 cc, greater than approximately 475 cc, greater than approximately 500 cc, greater than approximately 525 cc, greater than approximately 550 cc, greater than approximately 575 cc, greater than approximately 600 cc, greater than approximately 625 cc, greater than approximately 650 cc, greater than approximately 675 cc, or greater than approximately 700 cc. In some embodiments, the volume of the driver can be approximately 400 cc-600 cc, 425 cc-500 cc, approximately 500 cc-600 cc, approximately 500 cc-650 cc, approximately 550 cc-700 cc, approximately 600 cc-650 cc, approximately 600 cc-700 cc, or approximately 600 cc-800 cc.

"Fairway wood golf club heads" as used herein comprise a loft angle less than approximately 35 degrees, less than approximately 34 degrees, less than approximately 33 degrees, less than approximately 32 degrees, less than approximately 31 degrees, or less than approximately 30 degrees. Further, in some embodiments, the loft angle of the fairway wood club heads can be greater than approximately 12 degrees, greater than approximately 13 degrees, greater than approximately 14 degrees, greater than approximately 15 degrees, greater than approximately 16 degrees, greater than approximately 17 degrees, greater than approximately 18 degrees, greater than approximately 19 degrees, or greater than approximately 20 degrees. For example, in other embodiments, the loft angle of the fairway wood can be between 12 degrees and 35 degrees, between 15 degrees and 35 degrees, between 20 degrees and 35 degrees, or between 12 degrees and 30 degrees.

Further, "fairway wood golf club heads" as used herein comprises a volume less than approximately 400 cc, less than approximately 375 cc, less than approximately 350 cc, less than approximately 325 cc, less than approximately 300 cc, less than approximately 275 cc, less than approximately 250 cc, less than approximately 225 cc, or less than approximately 200 cc. In some embodiments, the volume of the fairway wood can be approximately 150 cc-200 cc, approximately 150 cc-250 cc, approximately 150 cc-300 cc, approximately 150 cc-350 cc, approximately 150 cc-400 cc, approximately 300 cc-400 cc, approximately 325 cc-400 cc, approximately 350 cc-400 cc, approximately 250 cc-400 cc, approximately 250-350 cc, or approximately 275-375 cc.

"Hybrid golf club heads" as used herein comprise a loft angle less than approximately 40 degrees, less than approximately 39 degrees, less than approximately 38 degrees, less than approximately 37 degrees, less than approximately 36 degrees, less than approximately 35 degrees, less than approximately 34 degrees, less than approximately 33 degrees, less than approximately 32 degrees, less than approximately 31 degrees, or less than approximately 30 degrees. Further, in many embodiments, the loft angle of the hybrid can be greater than approximately 16 degrees, greater than approximately 17 degrees, greater than approximately 18 degrees, greater than approximately 19 degrees, greater than approximately 20 degrees, greater than approximately 21 degrees, greater than approximately 22 degrees, greater than approximately 23 degrees, greater than approximately 24 degrees, or greater than approximately 25 degrees.

Further, "hybrid golf club heads" as used herein comprise a volume less than approximately 200 cc, less than approximately 175 cc, less than approximately 150 cc, less than approximately 125 cc, less than approximately 100 cc, or less than approximately 75 cc. In some embodiments, the volume of the hybrid can be approximately 100 cc-150 cc, approximately 75 cc-150 cc, approximately 100 cc-125 cc, or approximately 75 cc-125 cc.

The term "rest state" as used herein is defined as a state before impact, wherein a golf club head is in a static position and no force is imparted on the golf club head. The term "maximum deflected state" as used herein is defined as a snapshot in time in which a resilient member has the most deflection relative to the rest state. The term "transition state" as used herein is defined as the dynamic transition between the rest state and the maximum deflected state. The transition state consists of a force being imparted on the golf club head and the resulting dynamics associated with the force.

The term "low energy collision" as used herein is defined as a collision consisting of less than 1 joule, less than 5 joules, or less than 10 joules. The term "high energy collision" as used herein is defined as a collision consisting of more than 1 joule, more than 5 joules, or more than 10 joules.

The term "hot spot" as used herein can be defined as a discrete area on the strike face that has excessive impact response.

The golf club heads described in this disclosure can be formed from a metal, a metal alloy, a composite, or a combination of metals and composites. For example, the golf club head can be formed from, but not limited to, steel, steel alloys, stainless steel alloys, nickel, nickel alloys, cobalt, cobalt alloys, titanium alloys, an amorphous metal alloy, or other similar materials. For further example, the golf club head can be formed from, but not limited to, C300 steel, C350 steel, 17-4 stainless steel, or T9s+ titanium.

Other features and aspects will become apparent by consideration of the following detailed description and accompanying drawings. Before any embodiments of the disclosure are explained in detail, it should be understood that the disclosure is not limited in its application to the details, embodiments, or the arrangement of components as set forth in the following description or as illustrated in the drawings. The disclosure is capable of supporting other embodiments and of being practiced or carried out in various ways. It should be understood that the description of specific embodiments is not intended to limit the disclosure from covering all modifications, equivalents and alternatives falling within the spirit and scope of the disclosure. Also, it is to be understood that the phraseology and terminology used herein is for the purpose of description and should not be regarded as limiting.

Figure 2:
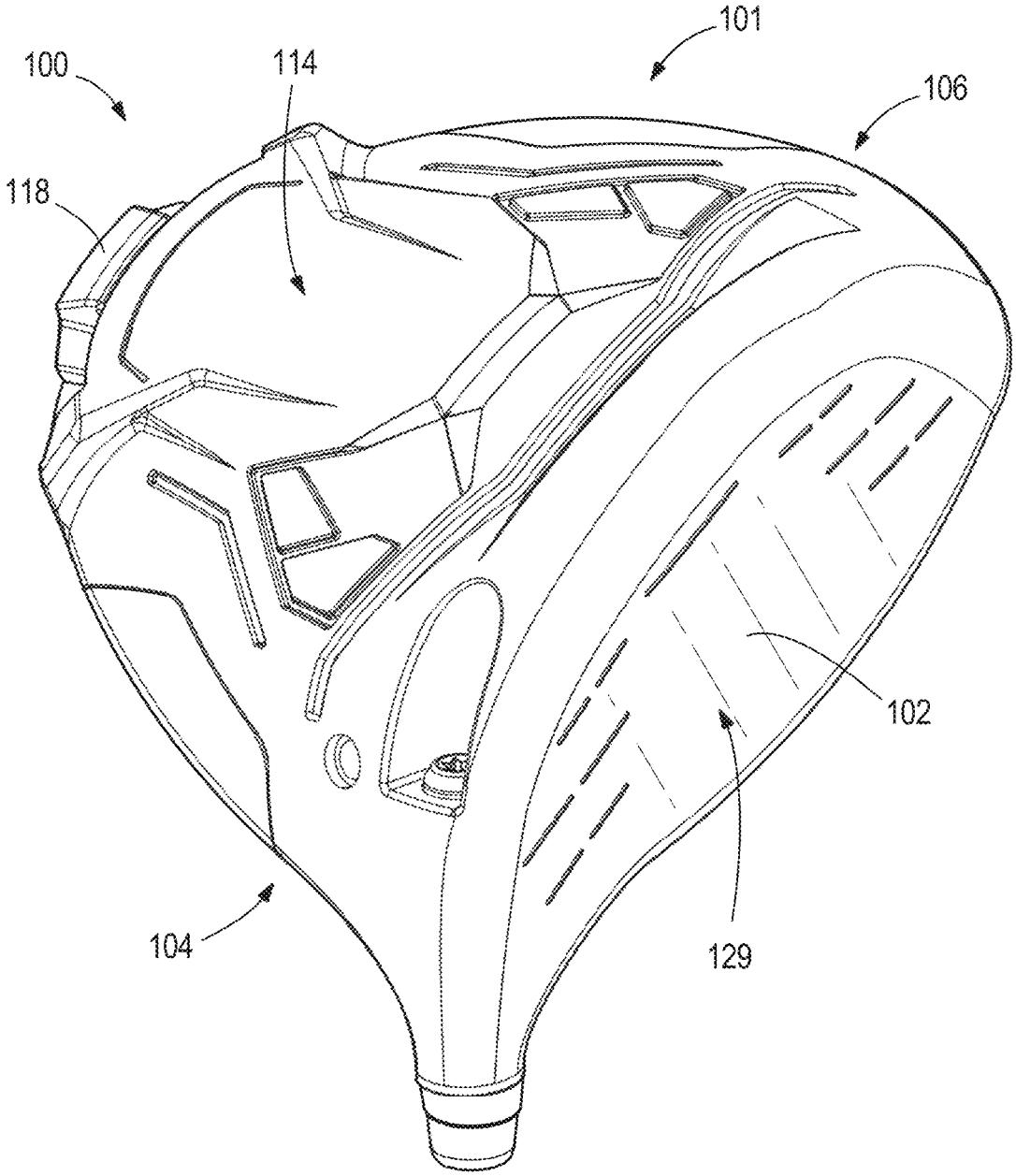
FIG. 2 illustrates a bottom perspective view of the wood-type club head of FIG. 1.
Figure 3:
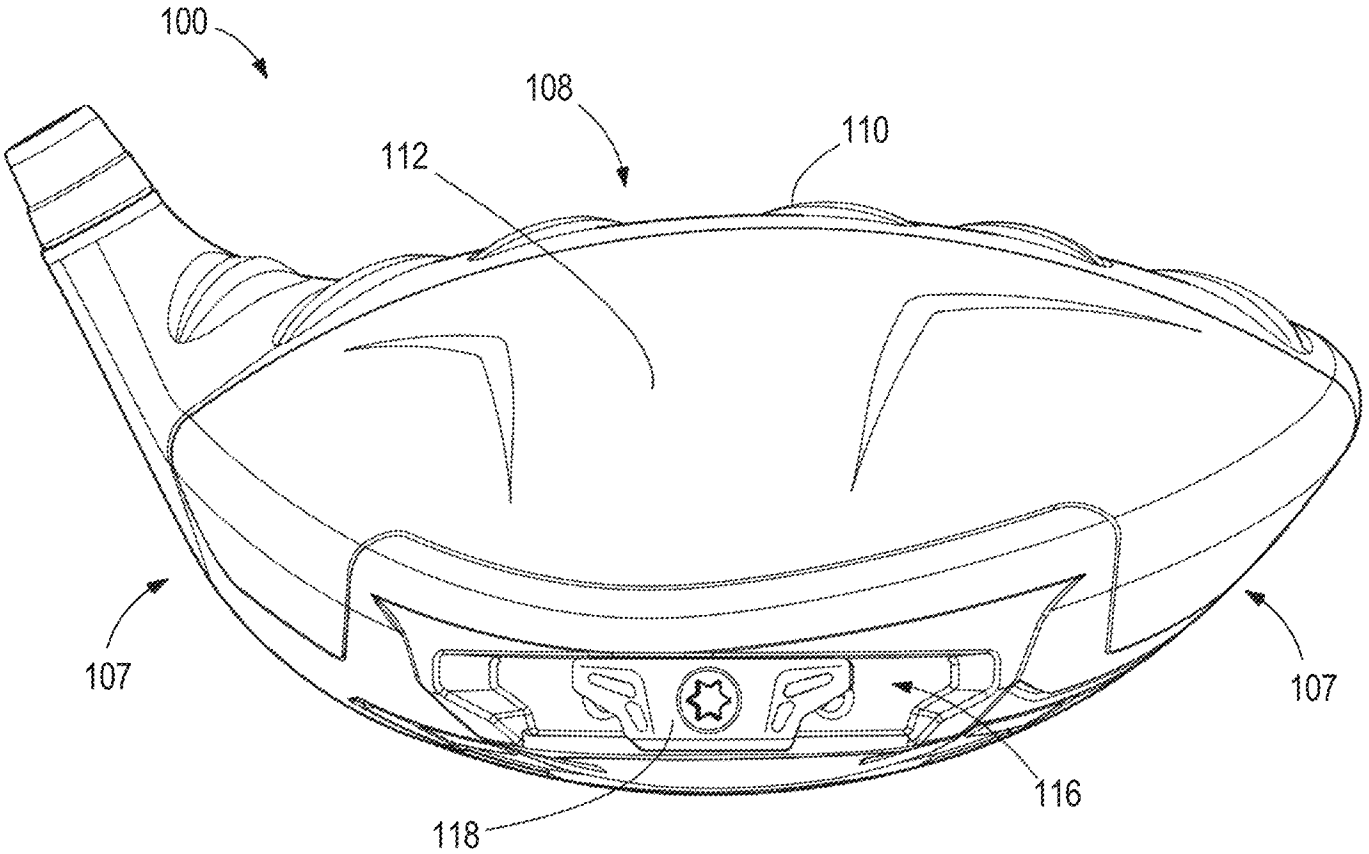
FIG. 3 illustrates a rear view of the wood-type club head of FIG. 1.

A wood-type golf club head 100 can comprise a resilient member 150 for normalizing impact response across the entire face of the club, as described in greater detail below. Referring to FIGS. 1-3, the resilient member 150 is located within a body 101 of the club head 100. The resilient member 150 can have an arcuate shape that comprises a continuous curvature. In other embodiments described below, the resilient member can further comprise an integral hinge. The body 101 can be either a unitary body or a multi-piece hollow body. As best shown in FIG. 1, the wood-type club head 100 can comprise a strike face 102 and a body 101, wherein the body 101 can comprise a single component or multiple components. The strike face 102 and the body 101 are secured together to define a substantially closed/hollow internal cavity 105. The club head 100 comprises a crown 108, a sole 114 opposite the crown 108, a heel 104, a toe 106 opposite the heel 104, a front 113, and a rear 115 opposite the front 113. The body 101 can further include a skirt 107 or trailing edge located between and adjoining the crown 108 and the sole 114, the skirt 107 extending from near the heel 104 to near the toe 106 of the club head 100.

The internal cavity 105 can be defined by the space between a crown inner surface 124, a sole inner surface 126, and a strike face inner surface 128. The resilient member 150 is located within the internal cavity 105. The body 101 can extend over the crown 108, the sole 114, the heel 104, the toe 106, the rear 115, and a perimeter of the front. The body 101 can define an opening in the front of the club head, and the strike face 102 can be positioned within the opening to form the club head. In other embodiments, the strike face 102 extends over the perimeter of the front and can include a return portion 110 extending rearward from the strike face 102. The return portion 110 can extend over at least one of the crown 108, the sole 114, the heel 104, and the toe 106. In embodiments comprising the return portion 110, the return portion 110 of the strike face 102 is secured to the body 101 to form the club head. In these embodiments, the club head can resemble a cup face or face wrap design. In some embodiments a portion of the strike face 102 can be formed from an insert that is welded or adhered to the club head 100.

The crown 108, skirt, sole 114, and or strike face 102 can be entirely made from a composite material or partially made from a composite material. A composite material can be adhered to any of the crown 108, skirt, sole 114, and or strike face 102. The use of lap joints can aid in the adhesion of the composite material to the body 101, sole 114, return portion 110, or strike face 102. The golf club head 100 can further comprises a multi-material crown 108 comprising a composite portion 112 and a return portion 110, wherein the return portion 110 is an extension of the strike face 102.

As illustrated in FIGS. 1-3, the club head comprises a hosel 120. The hosel 120 receives a hosel sleeve 122 and a shaft, wherein the hosel sleeve 122 can be coupled to an end of the shaft (not shown). The hosel sleeve 122 can be coupled with the hosel 120 in a plurality of configurations, thereby permitting the shaft to be secured to the hosel 120 at a plurality of angles.

The club head can comprise a weight port 116 configured to receive a removable weight 118. In many embodiments, the weight port 116 can be located in the sole 114 and/or in the skirt. The club head also can comprise a mass pad or weight pad (hereafter "mass pad"). In many embodiments, the mass pad can be located on the sole 114 and within the interior cavity. In other embodiments, the mass pad can be located on the sole 114 and skirt, and within the interior cavity. In other embodiments still, the club can comprise one or more weight ports 116, and one or more mass pads. The removable weight 118 and mass pad can adjust the moment of inertia (MOI) properties and center of gravity (CG) location.

The strike face 102 comprises a striking surface 129, configured to impact a golf ball, and a strike face inner surface 128, opposite the striking surface 129. The strike face 102 defines a thickness measured between the striking surface 129 and the strike face inner surface 128. The strike face 102 can comprise a variable thickness profile. The striking surface 129 further defines a face center or geometric center. In some embodiments, the face center can be located at a geometric center point of a face perimeter. In another approach, the face center of the striking surface 129 can be located in accordance with the definition of a golf governing body such as the United States Golf Association (US GA).

The strike face 102 perimeter can be located along an outer edge of the striking surface 129, where the curvature of the striking surface 129 deviates from the bulge and roll curvature. The striking surface 129 comprises a striking surface area measured within the boundary of the strike face 102 perimeter. In one approach, the spline method, as described above, can be used to determine the location of the outer edge where the curvature deviates from the bulge and roll of the striking surface 129.

The club head defines the loft plane tangent to the face center of the striking surface 129. The club head defines a ground plane tangent to the sole 114 when the club head is at an address position. The face center of the striking surface 129 defines an origin for a coordinate system having an x-axis, a y-axis, and a z-axis. The x-axis is a horizontal axis that extends through the face center in a direction extending from near the heel 104 to near the toe 106, parallel to the ground plane. The y-axis is a vertical axis that extends through the face center in a direction extending from near the sole 114 to near the crown 108, perpendicular to the ground plane. The y-axis is perpendicular to the x-axis. The z-axis is a horizontal axis that extends through the face center in a direction extending from near the front to near the rear 115, parallel to the ground plane. The z-axis is perpendicular to the x-axis and the y-axis. The x-axis extends in a positive direction toward the heel 104. The y-axis extends in a positive direction toward the crown 108. The z-axis extends in a positive direction toward the rear 115. Wherein the x-axis and y-axis form a xy plane, the x-axis and the z-axis form a xz plane, and the y-axis and the z-axis form a yz plane.

The club head further comprises a center of gravity (CG). In many embodiments, the center of gravity is located within the coordinate system defined above. The center of gravity can have a location on the x-axis, the y-axis, and the z-axis. The center of gravity further defines an origin of coordinate system having a CG x-axis, a CG y-axis, and a CG z-axis. The CG x-axis extends through the CG from near the heel 104 to near the toe 106. The CG y-axis extends through the CG from near the crown 108 to near the sole 114, the CG y-axis is perpendicular to the CG x-axis. The CG z-axis extends through the CG from near the front to near the rear 115, perpendicular to both the CG x-axis and the CG y-axis.

The CG x-axis is parallel to the x-axis, the CG y-axis is parallel to the y-axis, and the CG z-axis is parallel to the z-axis. In many embodiments, the center of gravity is strategically positioned toward the sole 114 and the rear 115 of the club head, to provide the club head 100 improved feel and playability.

The club head further comprises a moment of inertia Ixx about the CG x-axis (i.e., crown-to-sole moment of inertia) and a moment of inertia Iyy about the CG y-axis (i.e., heel-to-toe moment of inertia). The crown-to-sole moment of inertia Ixx and the heel-to-toe moment of inertia Iyy are increased or maximized to provide a high forgiving club head. The club heads comprising a resilient member described in this disclosure can be part of the club head comprising a high moment of inertia Ixx and a high moment of inertia Iyy. The high moment of inertia Ixx and the high moment of inertia Iyy provide the club head improved feel, forgiveness, and playability.

The resilient member 150 of the golf club head 100 provides structural support to the golf club and can normalize or reduce areas of excessive impact response, or "hot-spots," across the strike face 102. The resilient member 150 extends between the crown 108 and the sole 114 to provide structural rigidity to the golf club head 100. During low energy collisions (e.g., less than 1 joule, 5 joules, or 10 joules) the increased rigidity provided by the resilient member 150 reduces deflection of the club head 100. During high energy collisions, the resilient member 150 acts as a spring, as discussed in detail below.

The resilient member 150 forms a direct structural connection between the crown 108 and the sole 114. For example, one end of the resilient member 150 attaches to the crown 108 at a first attachment point 170, while an opposite end of the resilient member 150 attaches to the sole 114 at a second attachment point 172. The resilient member 150 can be integrally cast with the club head 100, or a portion of the club head 100 (e.g., the body 101, the return portion 110, the sole 114, or the crown 108). In some embodiments, the resilient member 150 only contacts the crown 108 and the sole 114.

The resilient member 150 can be mechanically attached to the crown 108 and the sole 114 by welding or epoxying. A set of receiving channels formed in the crown 108 and the sole 114 can be provided to facilitate attachment of the resilient member 150 to the body 101. The resilient member 150 can comprise a first end 151 and a second end 149. The first end 151 of the resilient member 150 can be harbored within the receiving channel of the crown 108. The second end 149 of the resilient member 150 can be harbored within the receiving channel of the sole. In other embodiments the resilient member 150 can be swaged with a portion of the body 101.

Figure 4:
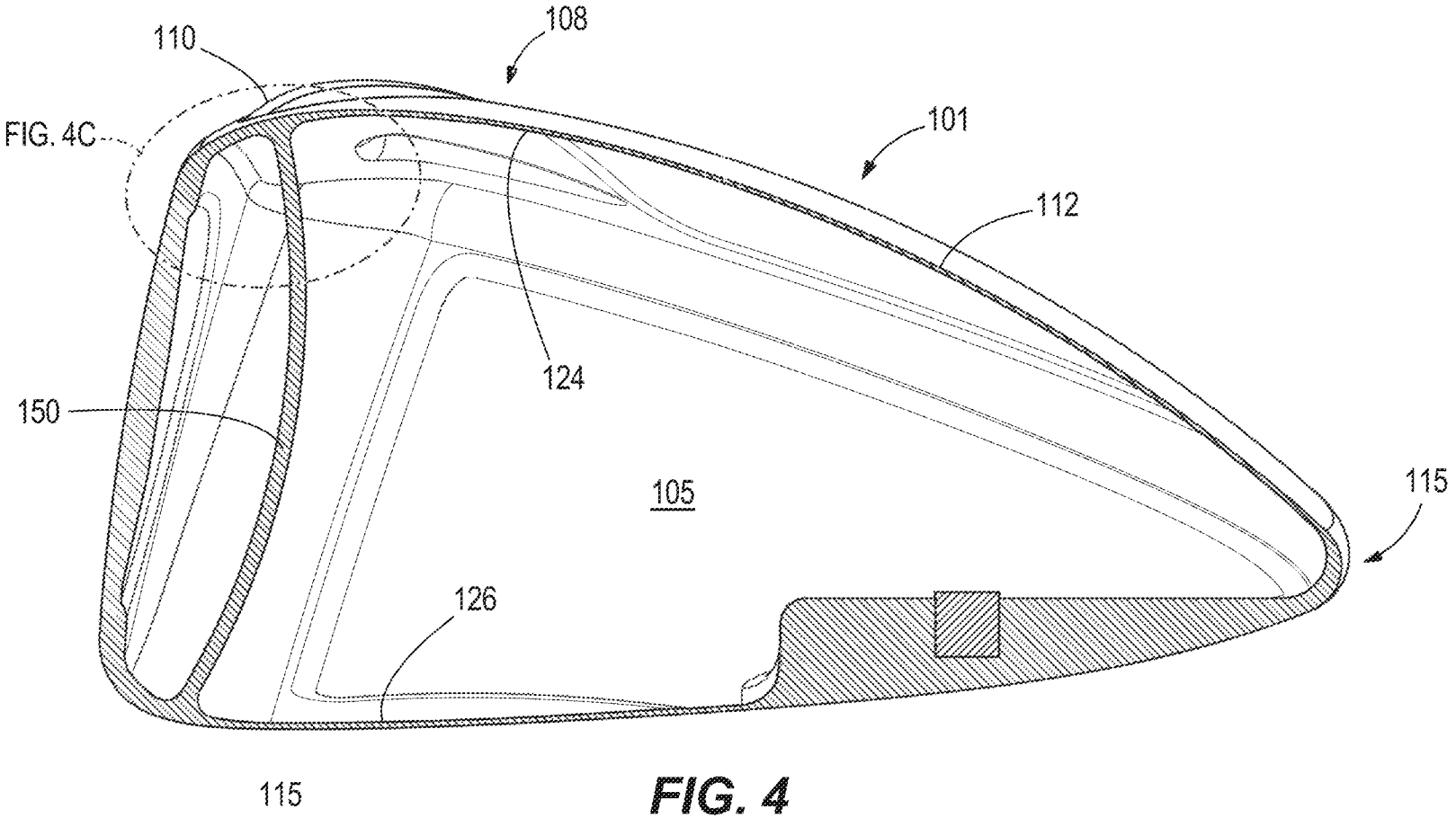
FIG. 4 illustrates a side view, in cross-section, of the wood-type club head of FIG. 1.

The resilient member 150 can have an arcuate shape to provide a desired impact response at the strike face 102. The arcuate shape has a radius of curvature when viewed from an XY plane 1000, as best shown in FIG. 4. The orientation of the curvature of the resilient member 150 is opposite that of the bulge of the strike face 102, such that the apex of the curvature is located further rearward of the first and second ends 151, 149 of the resilient member 150. Stated another way, when viewed from the strike face 102 (i.e., viewed from the front to the rear), the curvature is concave. In the illustrated embodiment, the radius of curvature is constant along an entire length of the resilient member 150 and is between 0.1 inches and 20 inches. In some embodiments the resilient member 150 radius of curvature is between 0.1 inch and 1 inch. In some embodiments the resilient member 150 radius of curvature is between 1 inch and 2 inches. In some embodiments the resilient member 150 radius of curvature is between 2 inches and 3 inches. In some embodiments the resilient member 150 radius of curvature is between 3 inches and 4 inches. In some embodiments the resilient member 150 radius of curvature is between 4 inches and 5 inches. In some embodiments the resilient member 150 radius of curvature is between 5 inches and 6 inches. In some embodiments the resilient member 150 radius of curvature is between 6 inches and 7 inches. In some embodiments the resilient member 150 radius of curvature is between 7 inches and 8 inches. In some embodiments the resilient member 150 radius of curvature is between 8 inches and 9 inches. In some embodiments the resilient member 150 radius of curvature is between 9 inches and 10 inches. In some embodiments the resilient member 150 radius of curvature is between 11 inches and 12 inches. In some embodiments the resilient member 150 radius of curvature is between 12 inches and 13 inches. In some embodiments the resilient member 150 radius of curvature is between 13 inches and 14 inches. In some embodiments the resilient member 150 radius of curvature is between 14 inches and 15 inches. In some embodiments the resilient member 150 radius of curvature is between 15 inches and 16 inches. In some embodiments the resilient member 150 radius of curvature is between 16 inches and 17 inches. In some embodiments the resilient member 150 radius of curvature is between 17 inches and 18 inches. In some embodiments the resilient member 150 radius of curvature is between 18 inches and 19 inches. In some embodiments the resilient member 150 radius of curvature is between 19 inches and 20 inches. In some embodiments the resilient member 150 radius of curvature is greater than 0.1 inch. In some embodiments the resilient member 150 radius of curvature is greater than 1 inch. In some embodiments the resilient member 150 radius of curvature is greater than 2 inches. In some embodiments the resilient member 150 radius of curvature is greater than 4 inches. In some embodiments the resilient member 150 radius of curvature is greater than 6 inches. In some embodiments the resilient member 150 radius of curvature is greater than 8 inches. In some embodiments the resilient member 150 radius of curvature is greater than 10 inches. In some embodiments the resilient member 150 radius of curvature is greater than 12 inches. In some embodiments the resilient member 150 radius of curvature is greater than 14 inches. In some embodiments the resilient member 150 radius of curvature is greater than 16 inches. In some embodiments the resilient member 150 radius of curvature is greater than 18 inches. In some embodiments the resilient member 150 radius of curvature is greater than 20 inches.

The radius of curvature provides the resilient member 150 with spring characteristics that affect the impact response of the strike face 102. More specifically, at impact, the resilient member 150 exerts a force on both the crown 108 and the sole 114 as the radius of curvature increases. The resilient member 150 comprises a chord length 162 that increases during impact. More specifically, as the radius of curvature increases in response to impact, the chord length 162 increases, as discussed in detail below. Each of FIGS. 4A and 4B juxtapose two views of club head 100 in a rest state prior to impact, and a deflected state at impact. In these drawings, the rest state is shown in dashed lines while the deflected state is shown in solid lines. As clearly shown, the chord length of the resilient member 150 increases from the rest state to the deflected state.

Figure 4B:
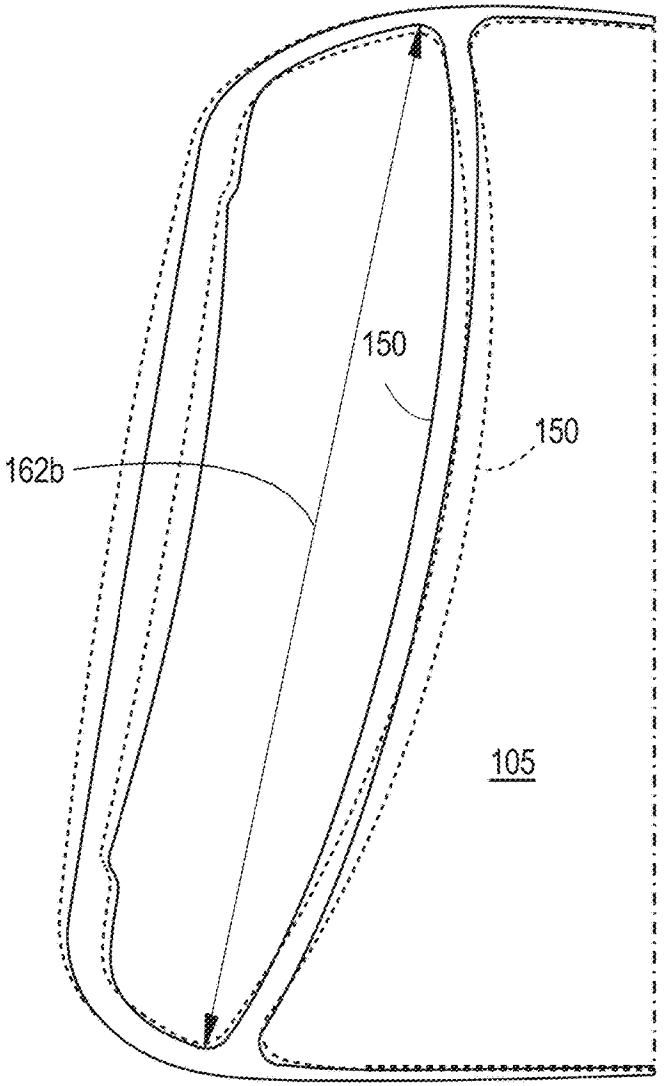
FIG. 4B illustrates a side view, in cross-section, of the wood-type club head of FIG. 1.
Figure 4A:
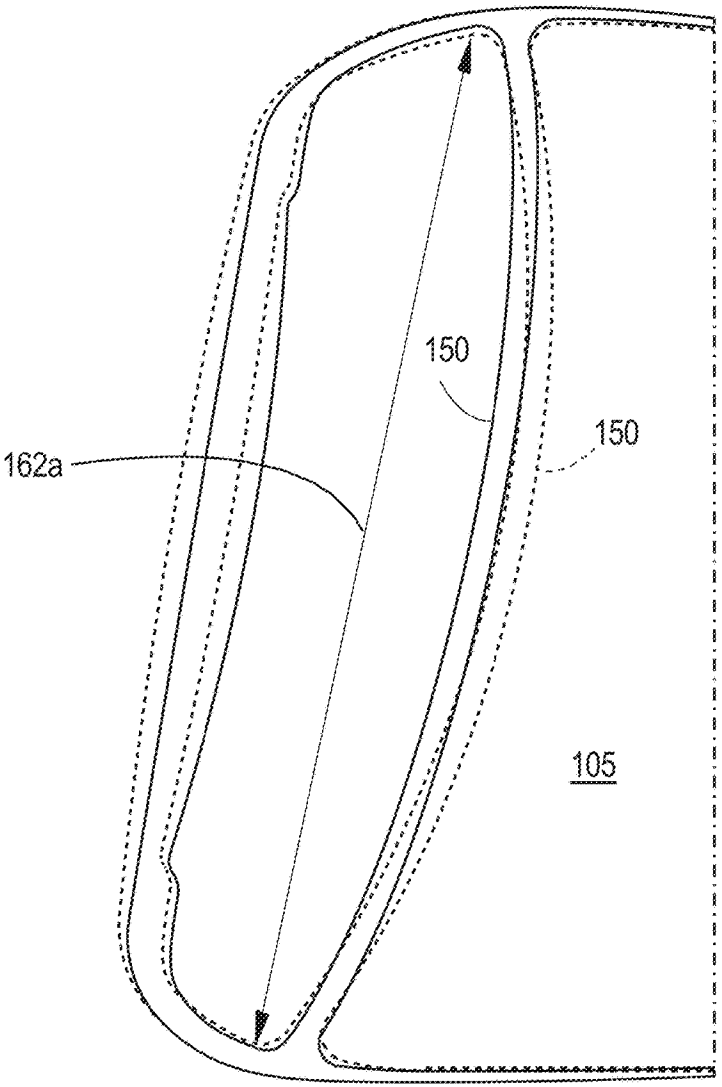
FIG. 4A illustrates a side view, in cross-section, of the wood-type club head of FIG. 1 in a rest state and in a maximum deflected state.

The resilient member 150 further acts as an expansion joint within the club head. During impact, a distance will increase between the sole 114 and the crown 108 of the club head 100, which in turn increases the chord length 162 of the resilient member 150 The force exerted on the crown and sole by the resilient member 150 causes the face to flex more than in a golf club having a member that does not exert the same force on the crown and the sole. As stated previously, the chord length 162 is dynamic and changes during impact. Referring to FIGS. 4A and 4B, a first chord length 162*a*, can be measured at the rest state. During impact, the first chord length 162*a* increases to a second chord length 162*b* measured with the resilient member 150 in a deflected state. In other words, the resilient member first end 151 and the resilient member second end 149 move further away from each other. The second chord length 162*b* is greater than the first chord length 162*a*. The increase in chord length 162 accommodates additional face flexure relative to a member that would restrict the change in chord length 162, such as a member that was devoid of curvature. A member connecting a crown to a sole devoid of curvature would not provide the same dynamic advantages as the resilient member 150 comprising curvature.

The first chord length 162*a* can range from 1.3 inch to 2.6 inch. The second chord length 162*b* can range from 1.35 inch to 2.7 inch. The change in chord length 162 between the first chord length 162*a* and the second chord length 162*b* can range from 0.02 inch and 0.04 inch. The second chord length 162*b* can be between 0.02 inch and 0.04 inch greater than the first chord length 162*a*. The first chord length 162*a* can be between 0.02 inch and 0.04 inch less than the second chord length 162*b*.

The support and structure provided by the resilient member 150, as discussed above, allows the thickness of the strike face 102 to be reduced relative to a club head without the resilient member 150. In some embodiments, the thickness of the strike face 102 can be reduced by 5%, 10%, or 15%. In some embodiments, the golf club head 100 has a maximum strike face thickness between 0.120 inch and 0.130 inch. In some embodiments, the maximum thickness of the strike face 102 is between 0.120 inch and 0.125 inch. In some embodiments, the maximum thickness of the strike face 102 is between 0.125 inch and 0.130 inch. In some embodiments, the minimum thickness of the strike face 102 is between 0.065 inch and 0.085 inch. In some embodiments, the minimum thickness of the strike face is between 0.065 inch and 0.070 inch. In some embodiments, the minimum thickness of the strike face is between 0.070 inch and 0.075 inch. In some embodiments, the minimum thickness of the strike face 102 is between 0.075 inch and 0.080 inch. In some embodiments, the minimum thickness of the strike face is between 0.080 inch and 0.085 inch. In some embodiments, the strike face 102 comprises a variable face thickness profile. A thin strike face 102 can provide more ball speed and increased length. In some examples, the additional length can be approximately 3-5 yards. Additionally, a club head devoid of a resilient member 150 having a similar face thickness would be less durable, as described more fully below.

The culmination of the curvilinear resilient member 150, the change in chord length 162, and the increased deflection of the crown 108 and sole 114, provide a balanced golf club head wherein the strike face 102 can have a reduced thickness, thereby increasing ball speed, while still maintaining durability.

Figure 5:
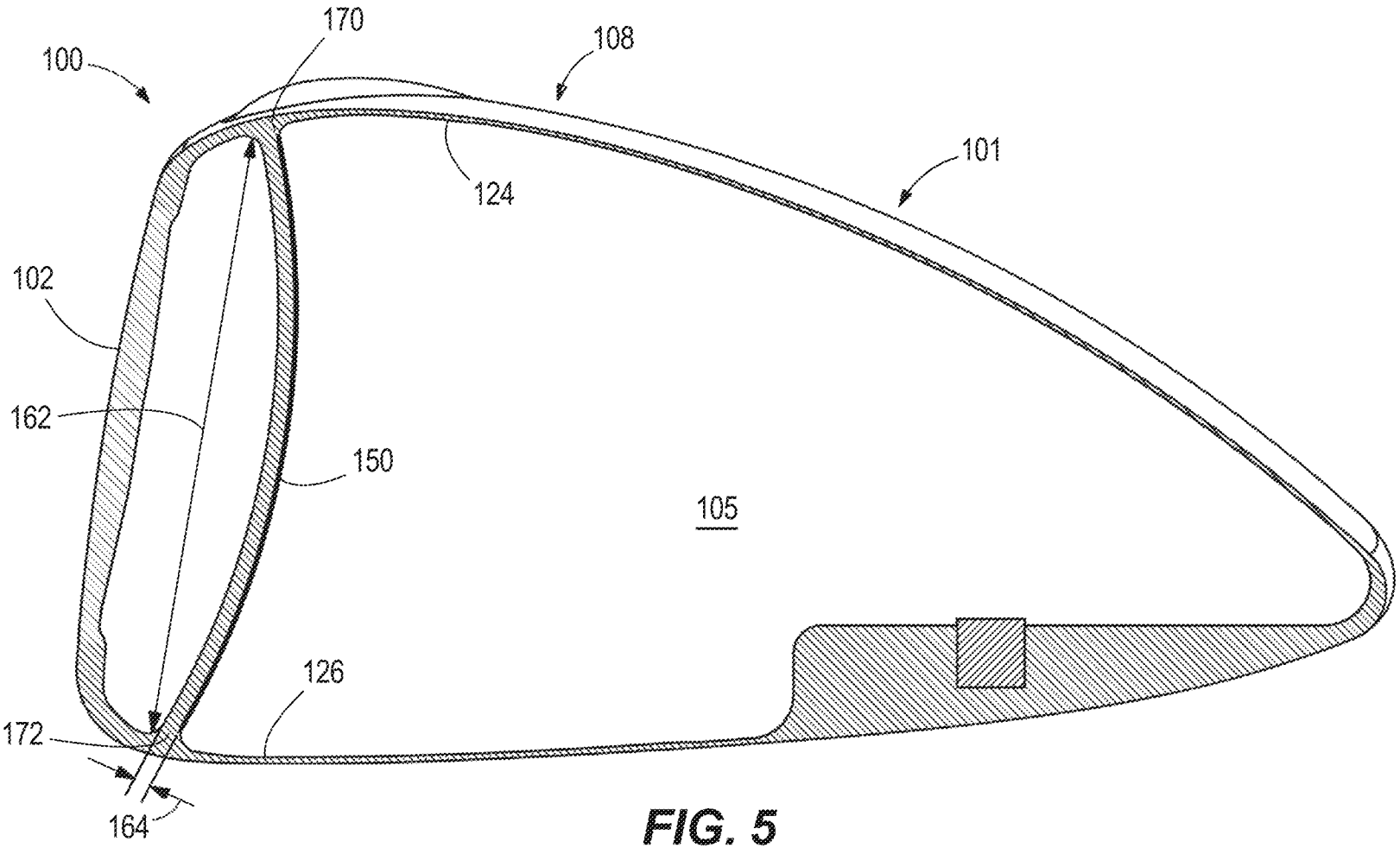
FIG. 5 illustrates a side view, in cross-section, of the wood-type club head of FIG. 1.
Figure 6:
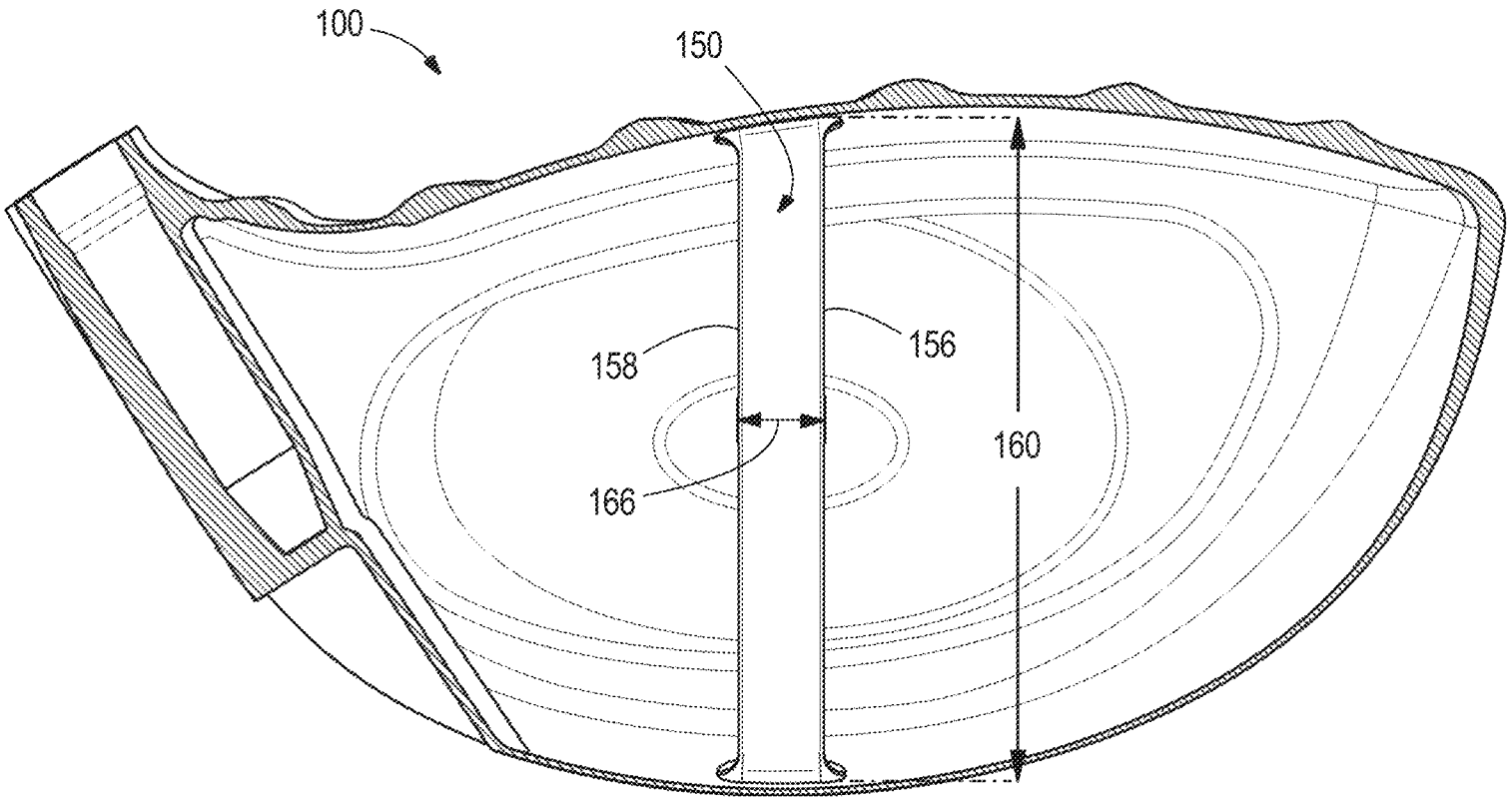
FIG. 6 illustrates a rear view, in cross-section, of the wood-type club head of FIG. 1.

With reference to FIGS. 4-6, the resilient member 150 comprises a front surface 152 located proximate the strike face 102, a rear surface 154 proximate the rear 115, a heel-side surface 156 proximate the heel 104, and a toe-side surface 158 proximate the toe 106. Further, the resilient member 150 comprises a length 160, a width 166, a depth, and the chord length 162. The length 160 is measured along the y-axis, the width 166 is measured along the x-axis, the depth 164 is measured perpendicular to the front surface 152 along the length 160 of the resilient member 150, and the chord length 162 is measured along the y-axis. The chord length 162 can be between 1.2 inches and 2.6 inches. As discussed above, the chord length 162 is a dynamic measurement. The length 160 can be between 1.3 inches to 2.8 inches. The width 166 can be between 0.1 inch and 0.45 inch. The depth can be between 0.01 inch and 0.2 inch. In some embodiments, the width 166 is greater than the depth 164 so that the resilient member 150 acts as a beam-like structure oriented approximately parallel to the strike face 102. As such, resilient member 150 is relatively stiff and resists displacement in the x-axis, and is relatively flexible and will yield easier to displacement in the y-axis. Greater flexibility in the y-axis direction allows for the curvature radius and chord length of the resilient member 150 to change during an impact.

Figure 4C:
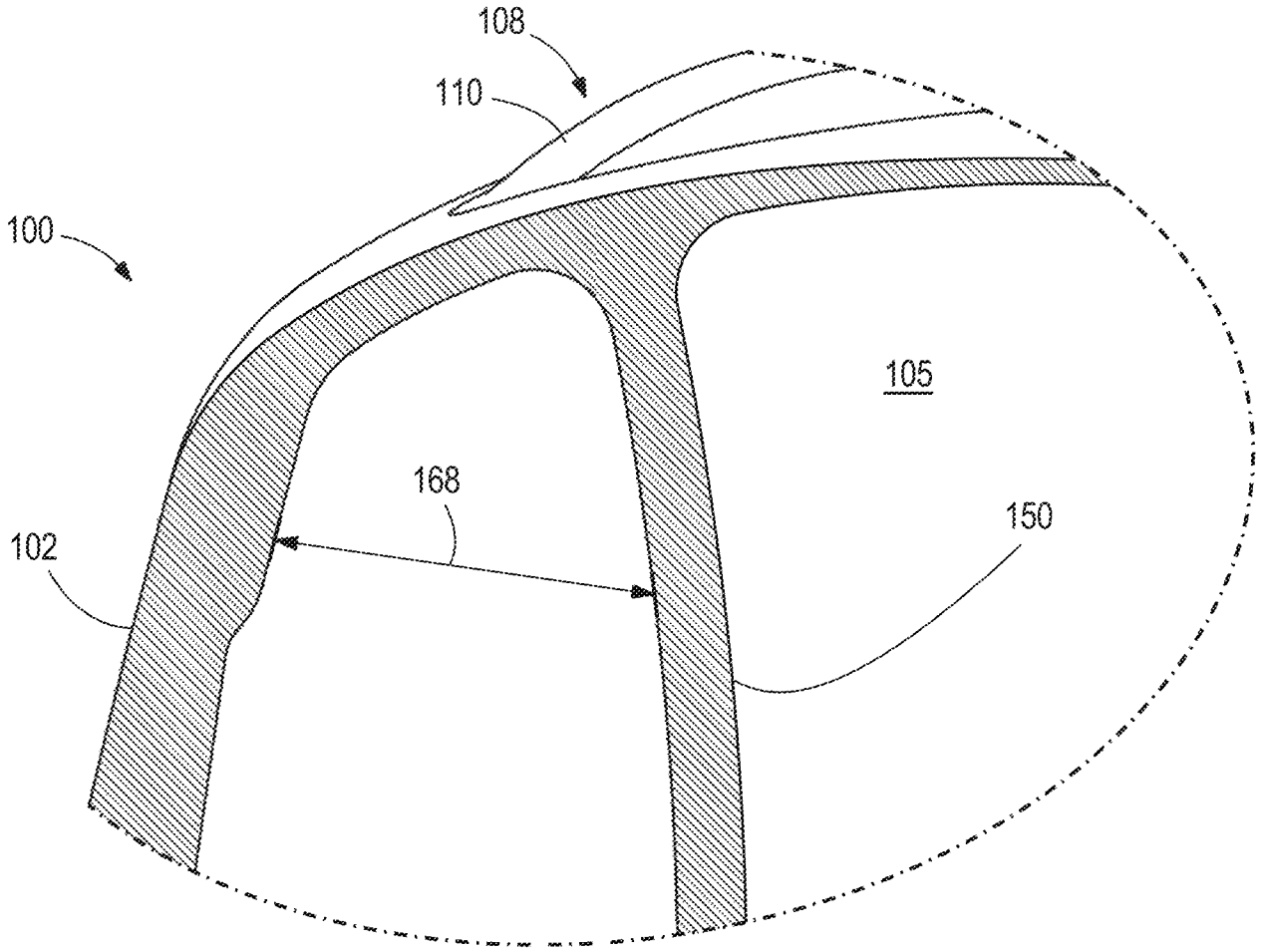
FIG. 4C is an enlarged detail of area 4C of FIG. 4.

Referring to FIG. 4C, the resilient member 150 is spaced a distance rearwardly from the strike face 102 (herein referred to as "the offset distance"). The offset distance 168 can be between 0.01 inch and 2.0 inches. In some embodiments the offset distance 168 can be between 0.01 inch and 0.5 inch. In some embodiments the offset distance 168 can be between 0.5 inch and 1 inch. In some embodiments the offset distance 168 can be between 1 inch and 1.5 inches. In some embodiments the offset distance 168 can be between 1.5 inches and 2 inches. The offset distance 168 varies along the length 160 of the resilient member 150. The offset distance 168 is measured perpendicular to the strike face 102 along the length 160 of the resilient member 150. The offset distance 168 of a particular resilient member 150 may produce unique stress alleviation that could be preferred in some applications. For example, the resilient member 150 can be located behind a known strike face hot spot (i.e., a location on the strike face 102 that has a high localized stress value). The resilient member 150 location relative to the strike face hot spot will alleviate the localized stress.

The resilient member 150 further can be positioned along a heel-to-to direction of the club (herein referred to as "the lateral distance"). In some embodiments, lateral distance is between 0 inch to 2 inches from the face center. In some embodiments the lateral distance is 0 inch to 1 inch from the face center. In some embodiments, the lateral distance is 1 inch to 2 inches from the face center. In some embodiments, the lateral distance is up to 2 inches heelward of the face center. In some embodiments, the lateral distance is up to 1 inch heelward from the face center. In some embodiments, the lateral distance is up to 2 inches toeward of the face center. In some embodiments, the lateral distance is up to 1 inch toeward of the face center. The lateral distance of a particular resilient member 150 may produce unique stress alleviation that could be preferred in some applications. For example, the resilient member 150 can be located behind and in line with a portion of the strike face having a high localized stress value. Located the resilient member 150 relative to this high stress area of the strike face can alleviate the localized stress.

The resilient member 150 can be made of multiple materials including, but not limited to, composites, titanium, aluminum, stainless steel, and steel. The resilient member 150 can be, but is not limited, to quasi-isotropic, unidirectional, or braided quasi-isotropic. The resilient member 150 can be but is not limited to laminate types such as symmetric, antisymmetric, or unsymmetric. The ply of the resilient member 150 can be but is not limited to cross-ply, angled ply, orthotropic, or anisotropic.

The resilient member 150 can be made from a metal alloy or composite material. In a particular embodiment the resilient member 150 is co-cast with the body 101. The resilient member 150 can be made from the same material as the body 101. The resilient member 150 can be made from a different material than the body 101. The body 101 can be made from titanium, steel, or stainless steel. The strike face 102 can be made from titanium, steel, or stainless steel. The body 101 can further comprise a composite portion 112 made from a fiber reinforced polymer.

In another embodiment, a club head 200 has a similar club head construction as the club head 100 but includes an alternative resilient member 250. Elements of the club head 200 that are similar to elements of club head 100 use similar reference numbers but use a series of numbers in the 200*s* rather than in the 100*s*. Accordingly, the club head 200 includes a crown 208, a sole 214, a strike face 202, an internal cavity 205, a heel 204, a toe 206, a return portion 210, a composite portion 212, and other elements described above.

The resilient member 250 includes one or more expansion members, such as an integral hinge 274, to accommodate additional expansion between the sole 214 and the crown 208. The expansion member can comprise a hinge 274 (as shown), a spring, a resilient material, or other material or structure that facilitates flexing of the resilient member 250 between the rest state and the deflected state. The resilient member 250 can comprise one, two, three, four, or more integral hinges 274. The integral hinge(s) 274 can be located towards a first end 251 of the resilient member 250, a second end 249 of the resilient member 250, at a midpoint of the resilient member 250, in the upper half of the resilient member 250, or in the lower half of the resilient member 250. In other words, the integral hinge(s) 274 can be located at any point along the resilient member 250. In embodiments with multiple integral hinges 274, the integral hinges 274 can be spaced equal or unequal distances apart. The integral hinge(s) 274 can form an included angle of between 10 and 80 degrees. The included angle is measured between a first hinge leg 275 a second hinge leg 276 of the integral hinge 274. Increasing the change in chord length 262 provides greater freedom for the strike face 202 to flex. As such, the club head 200 provides even more ball speed than the club head 200, as shown in the tests provided in the examples below.

The resilient member 250 can provide a direct structural connection between the crown 208 and the sole 214. For example, one end of the resilient member 250 attaches to the crown 208 at a first attachment point 270, while an opposite end of the resilient member 250 attaches to the sole 214 at a second attachment point 272. The resilient member 250 can be integrally cast with the club head 200, or a portion of the club head 200 (e.g., the body 201, the return portion 210, the sole 214, or the crown 208). In some embodiments, the resilient member 250 only contacts the crown 208 and the sole 214.

Figure 7:
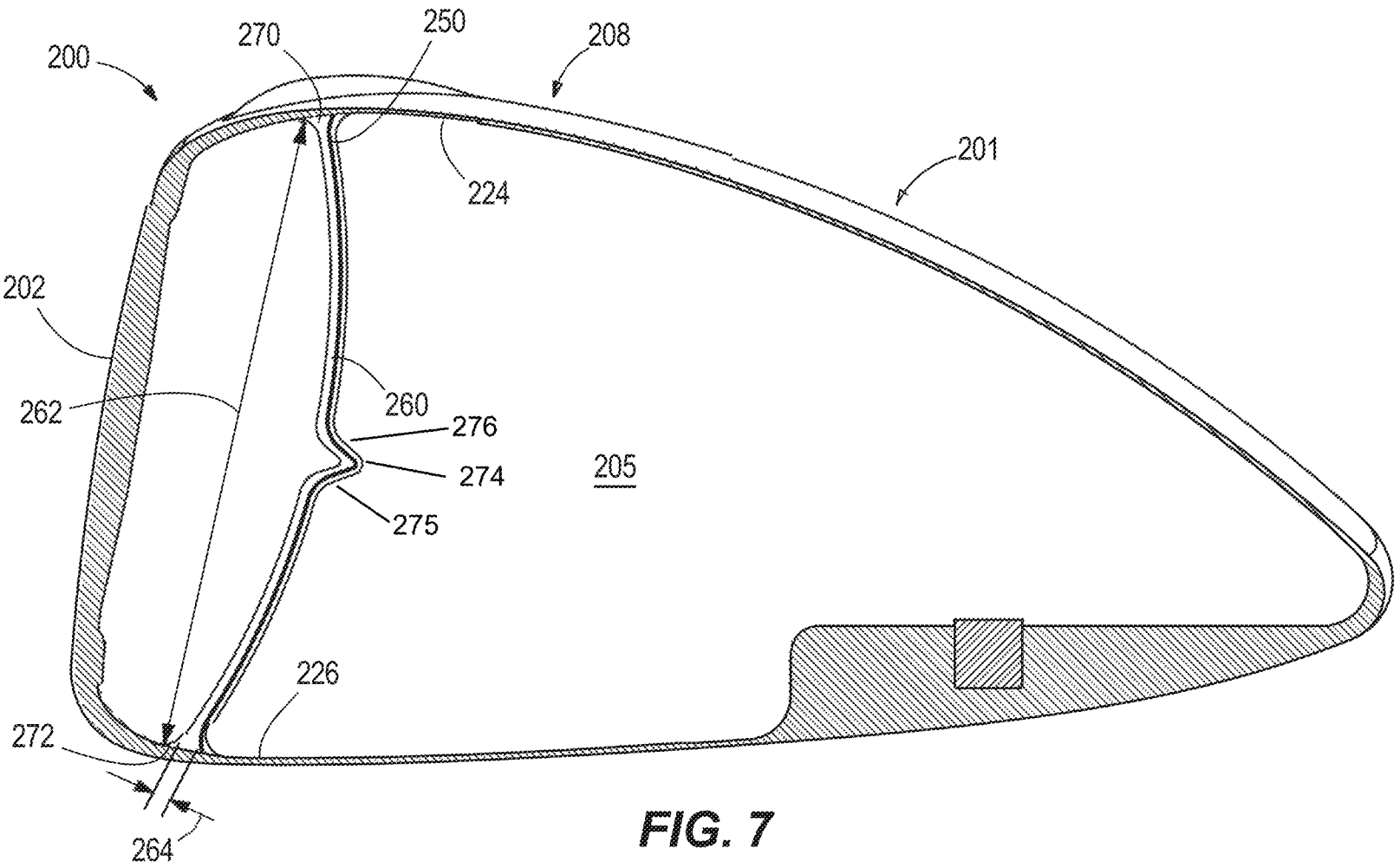
FIG. 7 illustrates a side view, in cross-section, of a wood-type club head.
Figure 8:
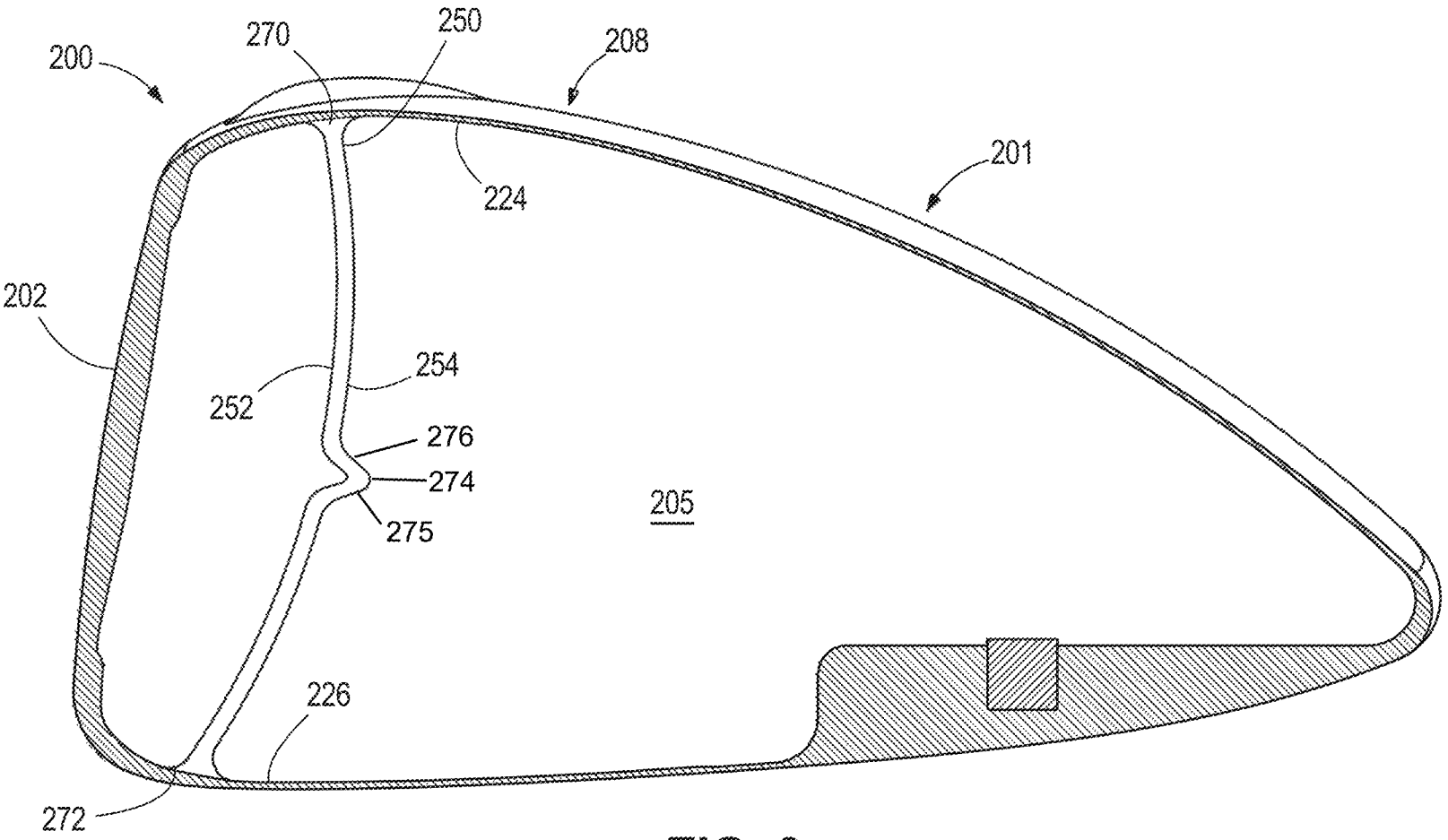
FIG. 8 illustrates a side view, in cross-section, of the wood-type club head of FIG. 7.

The resilient member 250 can generally trace an arcuate shape to provide a desired impact response at the strike face 202. Portions of the resilient member 250 that do not form the one or more integral hinges 274 can have a radius of curvature when viewed from the XY plane 1000. The orientation of the curvature of the resilient member 250 is opposite that of the strike face bulge, such that the apex of the curvature is located further rearward of the first and second ends 251, 249 of the resilient member 250. Stated another way, when viewed from the strike face 202 (i.e., viewed from the front to the rear), the curvature is concave. As shown in FIGS. 7 and 8, the radius of curvature of the resilient member, apart from the portion(s) forming integral hinge(s), is constant and is between 0.1 inches and 20 inches. In some embodiments the resilient member 250 radius of curvature is between 0.1 inch and 1 inch. In some embodiments the resilient member 250 radius of curvature is between 1 inch and 2 inches. In some embodiments the resilient member 250 radius of curvature is between 2 inches and 3 inches. In some embodiments the resilient member 250 radius of curvature is between 3 inches and 4 inches. In some embodiments the resilient member 250 radius of curvature is between 4 inches and 5 inches. In some embodiments the resilient member 250 radius of curvature is between 5 inches and 6 inches. In some embodiments the resilient member 250 radius of curvature is between 6 inches and 7 inches. In some embodiments the resilient member 250 radius of curvature is between 7 inches and 8 inches. In some embodiments the resilient member 250 radius of curvature is between 8 inches and 9 inches. In some embodiments the resilient member 250 radius of curvature is between 9 inches and 10 inches. In some embodiments the resilient member 250 radius of curvature is between 11 inches and 12 inches. In some embodiments the resilient member 250 radius of curvature is between 12 inches and 13 inches. In some embodiments the resilient member 250 radius of curvature is between 13 inches and 14 inches. In some embodiments the resilient member 250 radius of curvature is between 14 inches and 15 inches. In some embodiments the resilient member 250 radius of curvature is between 15 inches and 16 inches. In some embodiments the resilient member 250 radius of curvature is between 16 inches and 17 inches. In some embodiments the resilient member 250 radius of curvature is between 17 inches and 18 inches. In some embodiments the resilient member 250 radius of curvature is between 18 inches and 19 inches. In some embodiments the resilient member 250 radius of curvature is between 19 inches and 20 inches. In some embodiments the resilient member 250 radius of curvature is greater than 0.1 inch. In some embodiments the resilient member 250 radius of curvature is greater than 1 inch. In some embodiments the resilient member 250 radius of curvature is greater than 2 inches. In some embodiments the resilient member 250 radius of curvature is greater than 4 inches. In some embodiments the resilient member 250 radius of curvature is greater than 6 inches. In some embodiments the resilient member 250 radius of curvature is greater than 8 inches. In some embodiments the resilient member 250 radius of curvature is greater than 10 inches. In some embodiments the resilient member 250 radius of curvature is greater than 12 inches. In some embodiments the resilient member 250 radius of curvature is greater than 14 inches. In some embodiments the resilient member 250 radius of curvature is greater than 16 inches. In some embodiments the resilient member 250 radius of curvature is greater than 18 inches. In some embodiments the resilient member 250 radius of curvature is greater than 20 inches.

Figure 7B:
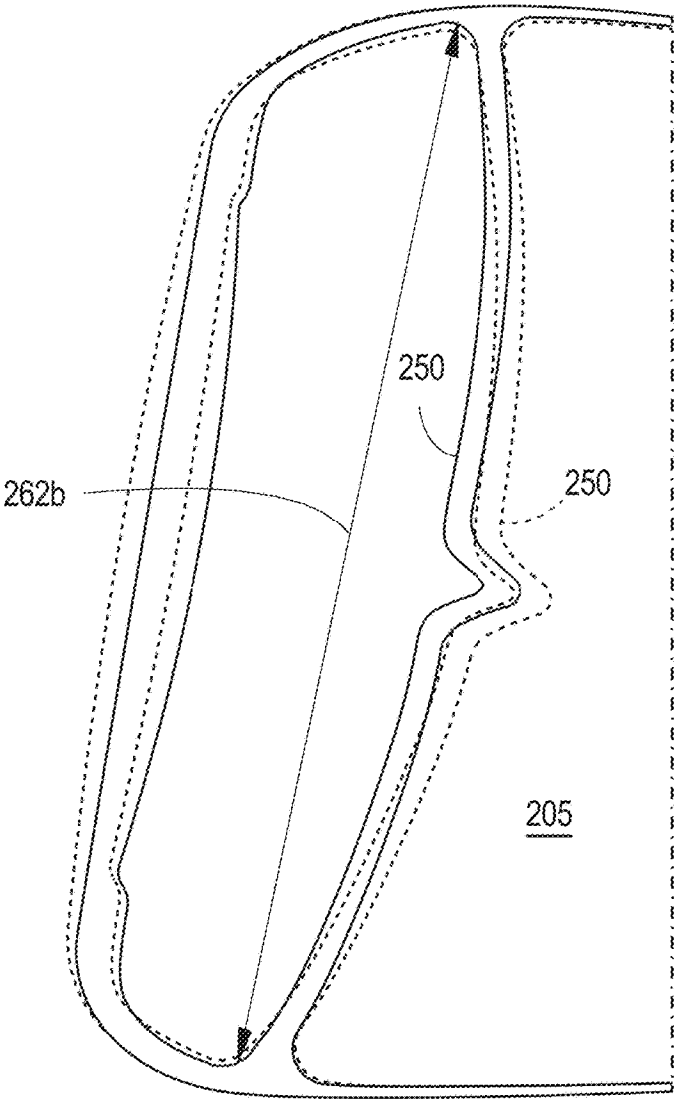
FIG. 7B illustrates a side view, in cross-section, of the wood-type club head of FIG. 7 in a rest state and in a maximum deflected state.
Figure 7A:
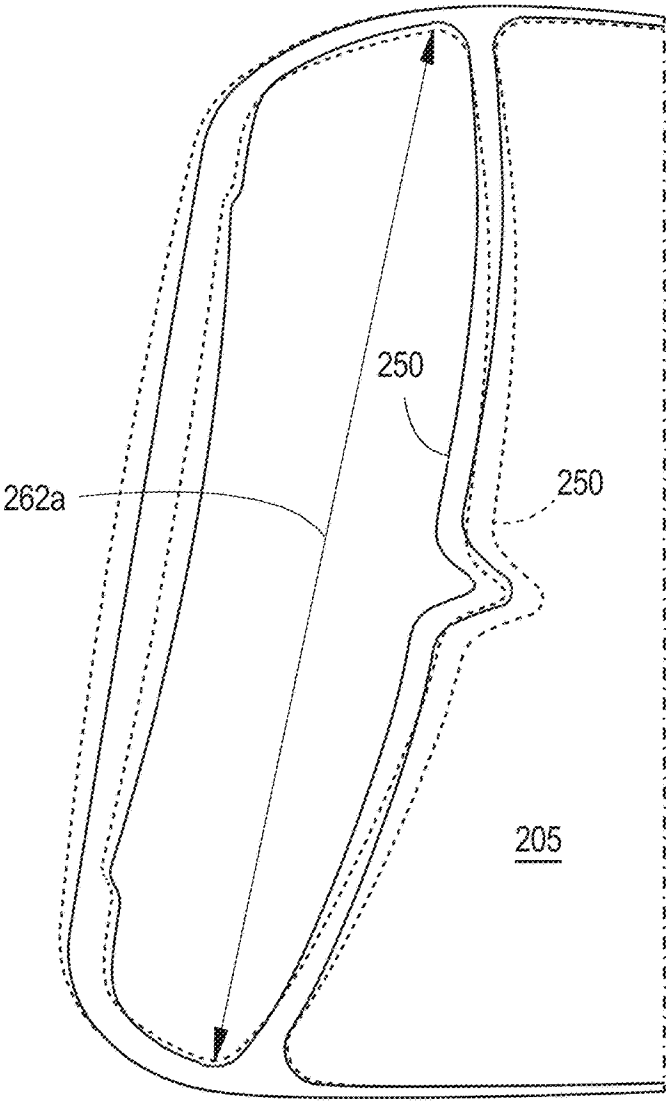
FIG. 7A illustrates a side view, in cross-section, of the wood-type club head of FIG. 7 in a rest state and a deflected state.

The radius of curvature provides the resilient member 250 with spring characteristics that affect the impact response of the strike face. More specifically, at impact, the resilient member 250 exerts a force on both the crown 208 and the sole 214 as the radius of curvature increases. The resilient member 250 comprises a chord length 262 that increases during impact. More specifically, as the radius of curvature increases in response to an impact, the chord length 262 also increases. The response of club head 200 is similar to that shown in FIGS. 4A and 4B for club head 100, where the chord length 262 increases from the rest state to the deflected state The resilient member 250 further acts as an expansion joint within the club head. During impact, a distance will increase between the sole 114 and the crown 108 of the club head 200, which in turn increases the chord length 262 of the resilient member 250. The force exerted on the crown and sole by the resilient member 250 causes the face to flex more than in a golf club having a member that does not exert the same force on the crown and the sole. As stated previously the chord length 262 is dynamic and changes during impact. Referring to FIGS. 7A and 7B, a first chord length 262*a*, can be measured at the rest state. During impact, the first chord length 262*a* increases to a second chord length 262*b* measured with the resilient member 250 in a deflected state. In other words, the resilient member first end 251 and the resilient member second end 249 move further away from each other. The second chord length 262*b* is greater than the first chord length 262*a*. The increase in chord length 262 accommodates additional face flexure relative to a member that would restrict the change in chord length 262, such as a member that was devoid of curvature. A member connecting a crown to a sole devoid of curvature would not provide the same dynamic advantages as the resilient member 250 comprising curvature.

The first chord length 262*a* can range from 1.3 inch to 2.6 inch. The second chord length 262*b* can range from 1.35 inch to 2.7 inch. The change in chord length 262 between the first chord length 262*a* and the second chord length 262*b* can range from 0.02 inch and 0.04 inch. The second chord length 262*b* can be between 0.02 inch and 0.04 inch greater than the first chord length 262*a*. The first chord length 262*a* can be between 0.02 inch and 0.04 inch less than the second chord length 262*b*.

Figure 9:
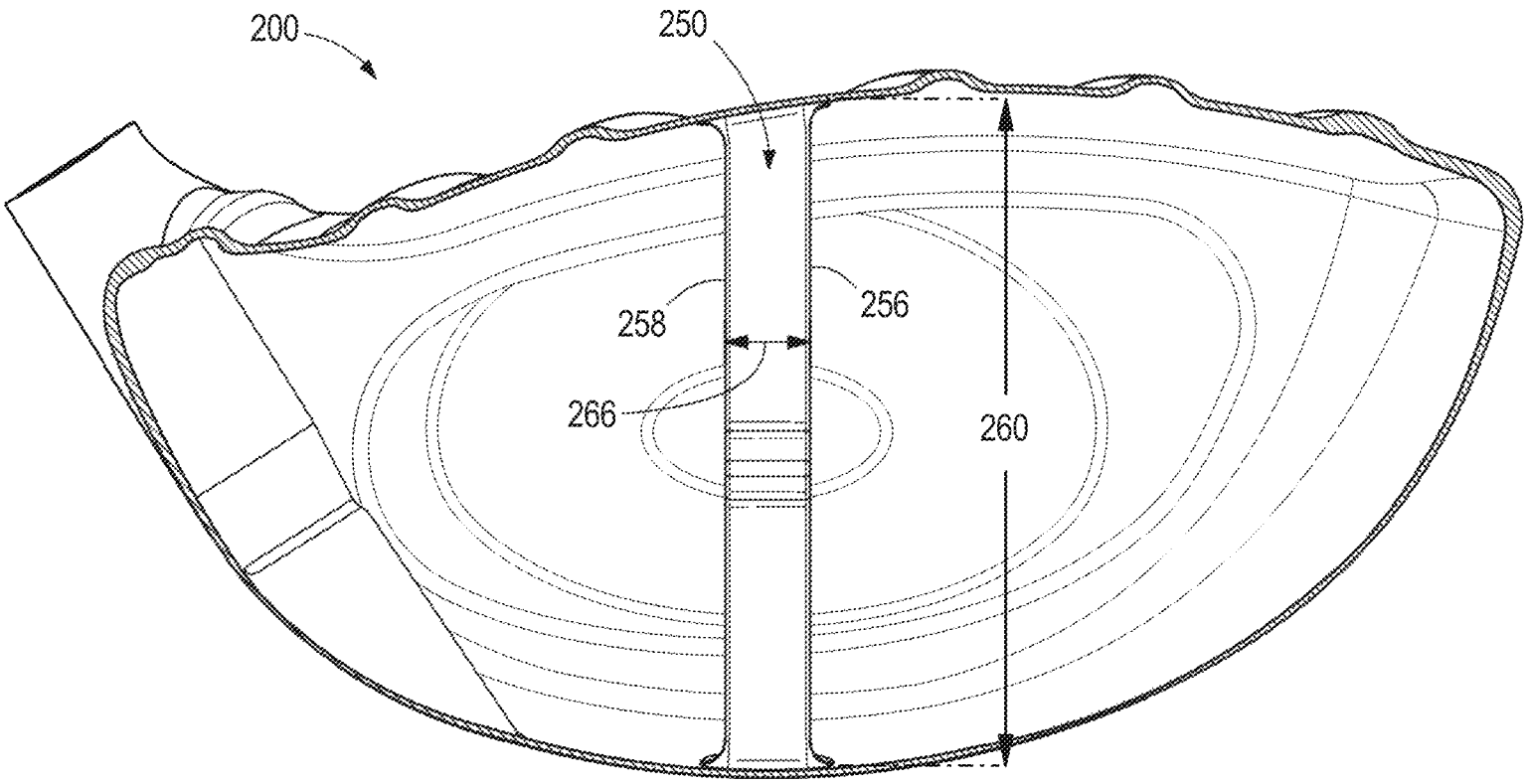
FIG. 9 illustrates a rear view, in cross-section, of the wood-type club head of FIG. 7.

With reference to FIGS. 8 and 9, the resilient member 250 comprises a front surface 252 located proximate the strike face 202, a rear surface 254 proximate the rear 215, a heel-side surface 256 proximate the heel 204, and a toe-side surface 258 proximate the toe 206. Further, the resilient member 250 comprises a length 260, a width 266, a depth, and the chord length 262. The length 260 is measured along the y-axis, the width 266 is measured along the x-axis, the depth 264 is measured perpendicular to the front surface 252 along the length 260 of the resilient member 250, and the chord length 262 is measured along the y-axis. The chord length 262 can be between 1.2 inches and 2.6 inches. As discussed above the chord length 262 is a dynamic measurement. The length 260 can be between 1.3 inches to 2.8 inches. The width 266 can be between 0.1 inch and 0.45 inch. The depth can be between 0.01 inch and 0.2 inch. In some embodiments, the width 266 is greater than the depth 264 so that the resilient member 250 acts as a beam-like structure oriented approximately parallel to the strike face 202. As such, resilient member 250 is relatively stiff and resists displacement along the x-axis, and is relatively flexible and will yield easier to displacement along the y-axis. Greater flexibility in the y-axis direction allows for the curvature radius and chord length of the resilient member 250 to change during an impact.

EXAMPLES

The following are descriptions of exemplary club heads and control club heads used in the Examples provided below. These club heads were used in different performance tests and in different combinations, as described in further detail below.

The first exemplary club head comprised a resilient member similar to the one described above in club head 100. The first exemplary club head resilient member was continuously curvilinear, and further comprised a 3-inch radius of curvature. The first exemplary club head comprised a maximum face thickness of 0.124 inch and a minimum face thickness of 0.074 inch.

The second exemplary club head comprised a resilient member similar to the one described above in club head 200. The second exemplary club head resilient member was generally curvilinear with a 3 inch radius of curvature but also included an integral hinge. The first exemplary club head comprised a maximum face thickness of 0.124 inch and a minimum face thickness of 0.074 inch.

The first control club head comprised a conventional club head having a structural member connecting the sole to the crown that was devoid of any curvature. In other words, the first control club head comprised a straight, structural member that constricted the movement of the crown and sole. The first control club head comprised a maximum face thickness of 0.124 inch and a minimum face thickness of 0.074 inch.

The second control club head comprised a conventional club head. The second control club head was devoid of a member connecting the crown to the sole. The second control club head comprised a maximum face thickness of 0.132 inch and a minimum face thickness of 0.082 inch.

The third control club head comprised a thin strike face construction, however, was devoid of a member connecting the crown to the sole. The third control club head comprised a maximum face thickness of 0.124 inch and a minimum face thickness of 0.074 inch.

Example 1

In a first performance test, internal energies resulting from impacts were compared among the first exemplary club head, the second exemplary club head, and first control club head. The first performance test consisted of a golf ball impact simulation on the first exemplary club head, the second exemplary club head and the first control club head. The simulation involved impacting the geometric center of the club head with a golf ball-like object at 100 MPH. The first performance test results were as follows: the first exemplary club head had an internal energy of 83.6 lbf-inch; the second exemplary club head had an internal energy of 89.4 lbf-inch; and the first control club head had an internal energy of 74.8 lbf-inch.

The first performance test proved in simulation that for similar test impacts, the first exemplary club head and the second exemplary club head responded with increased internal energy relative to the first control club head. The first exemplary club head had 8.8 lbf-inch more internal energy than the first control club head. This increase in internal energy will yield approximately 0.25 to 4 MPH in additional ball speed. The second exemplary club head had 14.6 lbf-inch more internal energy than the first control club head, which would yield approximately 0.25 to 4 MPH in additional ball speed.

Further, the first performance test resulted in a 0.021 inch change in chord length for the first exemplary club head, a 0.029 inch change in chord length for the second exemplary club head, and a 0.012 inch change in chord length for the first control club head. The change in chord length increased the expansion between the crown and sole and therefore aided the increase in face deflection. The first exemplary club head had a 0.009 inch greater change in chord length compared to the first control club head. The second exemplary club head had a 0.017 inch greater change in chord length compared to the first control club head. The first control club head lesser change in chord length is due to the resilient member having a straight geometry (i.e., devoid of curvature). A club head having a greater change in chord length results in a greater ball speed as there is more deflection occurring within the club.

Figure 11:
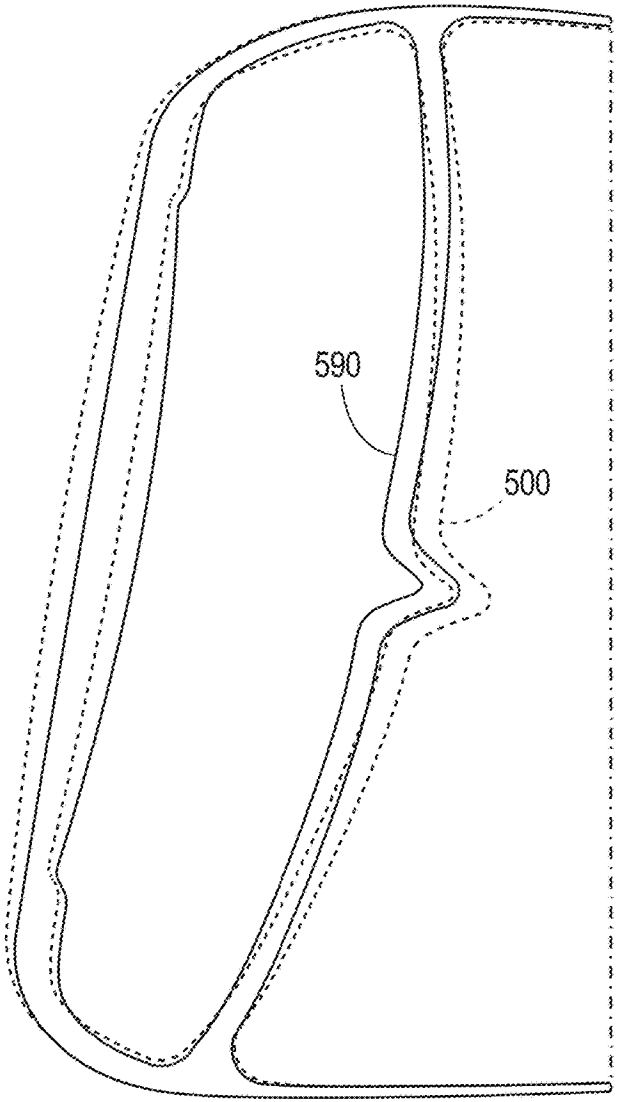
FIG. 11 illustrates an overlay view, in cross-section, of the golf club head of FIG. 7 in a rest state and a deflected state.
Figure 10:
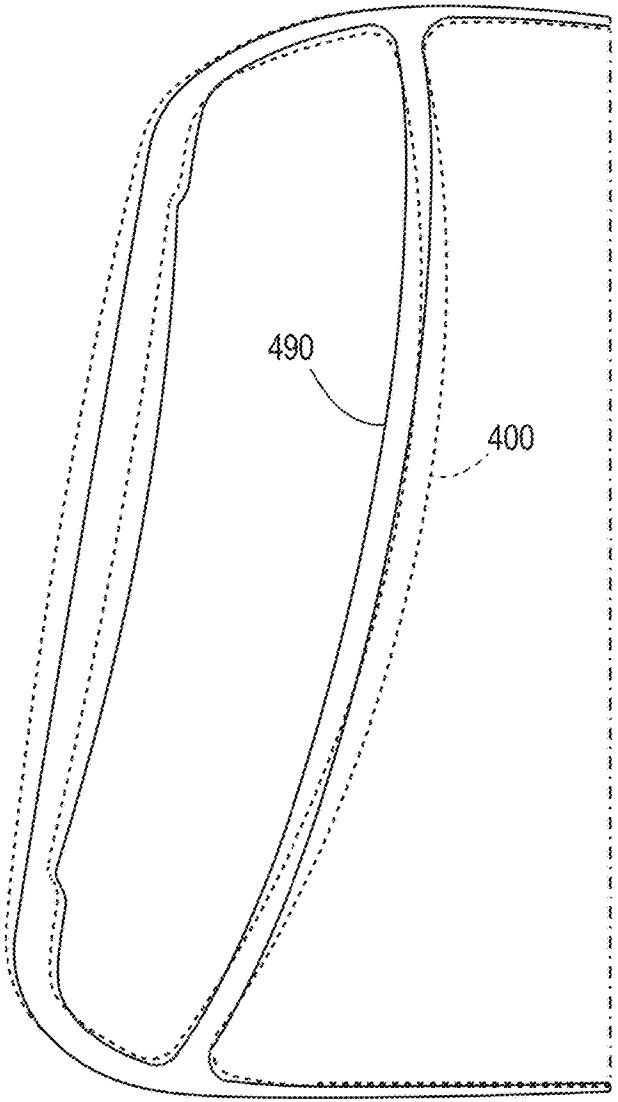
FIG. 10 illustrates an overlay view of the golf club head of FIG. 1 before and after impact.
Figure 12:
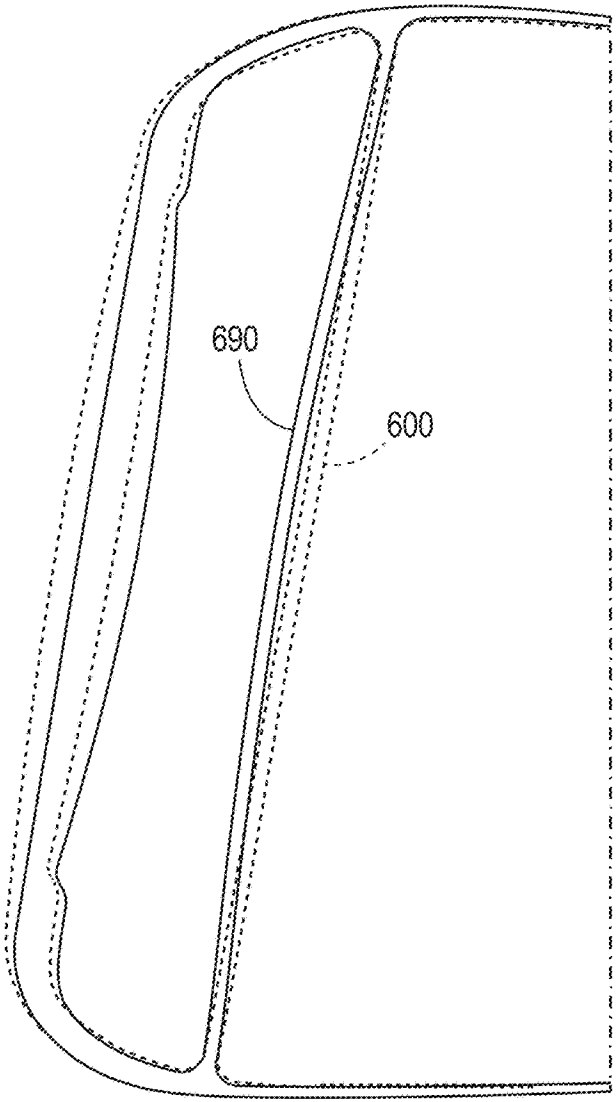
FIG. 12 illustrates an overlay view, in cross-section, of a golf club head comprising a connecting member extending between a crown and a sole of the golf club head and devoid of curvature, in both a rest state and a deflected state.

The first performance test proved the first exemplary club head and the second exemplary club head provide greater ball speed relative to the first control club head. The first performance test further proved the member devoid of curvature restricts the motion of the crown and the sole as the change in chord length is vastly different for the first exemplary club head and the second exemplary club head when compared to the first control club head. Referring to FIG. 10, an overlay is shown of the first exemplary club head before impact 400 and the first exemplary club head at maximum deflection during impact 490. Referring to FIG. 11, an overlay is shown of the second exemplary club head before impact 500 and the second exemplary club head at maximum deflection during impact 590. Referring to FIG. 12 an overlay is shown of the first control club head before impact 600 and the first control club head at maximum deflection during impact 690. As depicted in FIGS. 10-12 the change in chord length is greater in the first exemplary club head and the second exemplary club head compared to the first control club head. Thus, the first control club head restricts the face flexure more than the first exemplary club head and the second exemplary club head. Therefore, the first control club head is a less efficient design that would not yield the same ball speed gains as the first exemplary club head and the second exemplary club head.

Example 2

Figure 13:
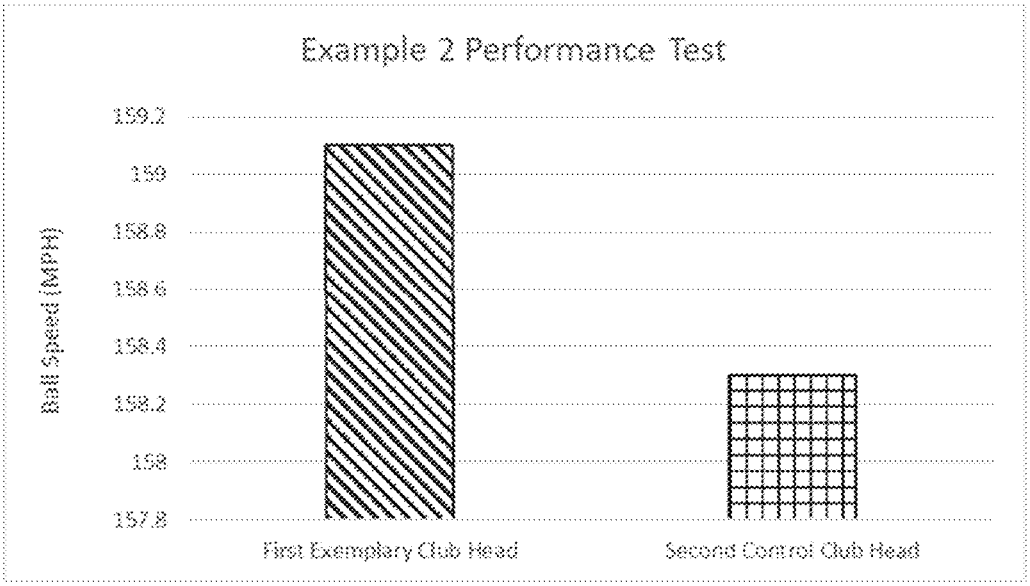
FIG. 13 illustrates a bar graph of ball speed for each club that was observed in a test described in Example 2.

In a second performance test, resulting ball speeds from impacts were compared between the first exemplary club head and the second control club head. The second performance test consisted of 15 players hitting ten shots with the first exemplary club head and ten shots with the second control club head. The test recorded data for each shot, including ball speed. At the conclusion of the test, the data for each club was averaged. Referring to FIG. 13, the first exemplary club head resulted in a 159.1 MPH ball speed and the second control club head resulted in a 158.3 MPH ball speed.

The second performance test proved the first exemplary club head comprising the curved resilient member and thin face created a 0.8 MPH gain in ball speed over the second control club head devoid of a member connecting the crown to the sole and comprising a thicker face. The first exemplary club head thin face and the expansion joint action of the resilient member provided this gain in ball speed.

Example 3

Figure 14:
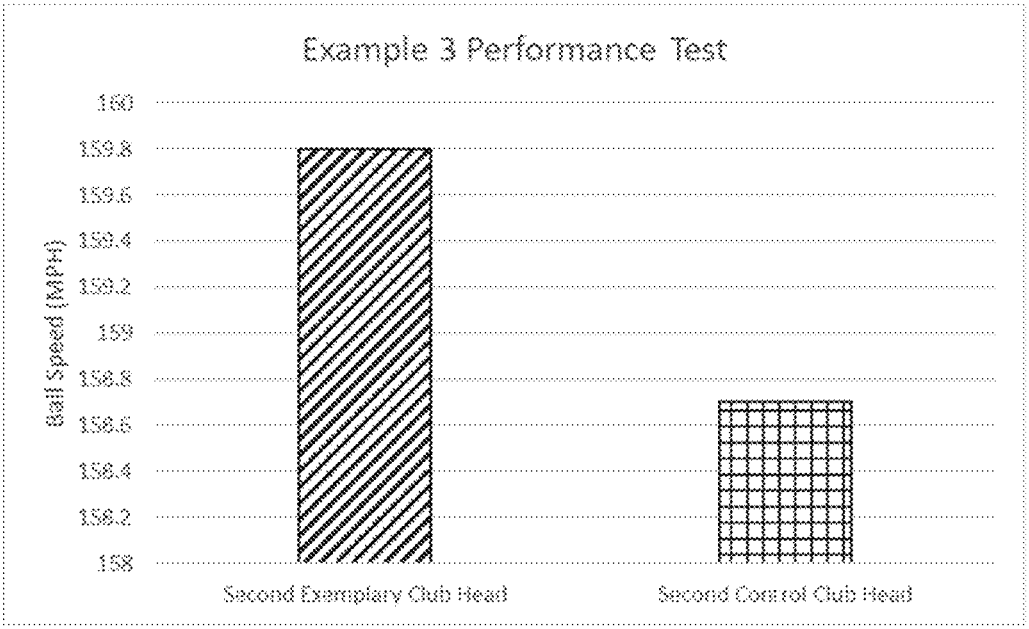
FIG. 14 illustrates a bar graph of ball speed for each club that was observed in a test described in Example 3.

In a third performance test, resulting ball speeds from impacts were compared between the second exemplary club head and the second control club head. The third performance test consisted of 15 players hitting ten shots with the first exemplary club head and ten shots with the second control club head. The test recorded data for each shot, including ball speed. At the conclusion of the test, the data for each club was averaged. Referring to FIG. 14, the second exemplary club head resulted in a 159.8 MPH ball speed. The second control club head resulted in a 158.7 MPH ball speed.

The third performance test proved the second exemplary club head comprising the curved resilient member further comprising an integral hinge and thin face created a 1.1 MPH gain in ball speed over the second control club head devoid of a member connecting the crown to the sole and comprising a thicker face. The second exemplary club head thin face and the expansion joint action of the resilient member provided this gain in ball speed.

Example 4

In a fourth performance test, durability was compared between the first exemplary club head to the second control club head. The fourth performance test consisted of a durability test wherein each club head was subjected to 2000 golf ball impacts at 120 MPH, 500 golf ball impacts at 130 MPH, 500 golf ball impacts at 140 MPH and 500 golf ball impacts at 150 MPH. The number of impacts was measured until failure of the golf club head.

Figure 15:
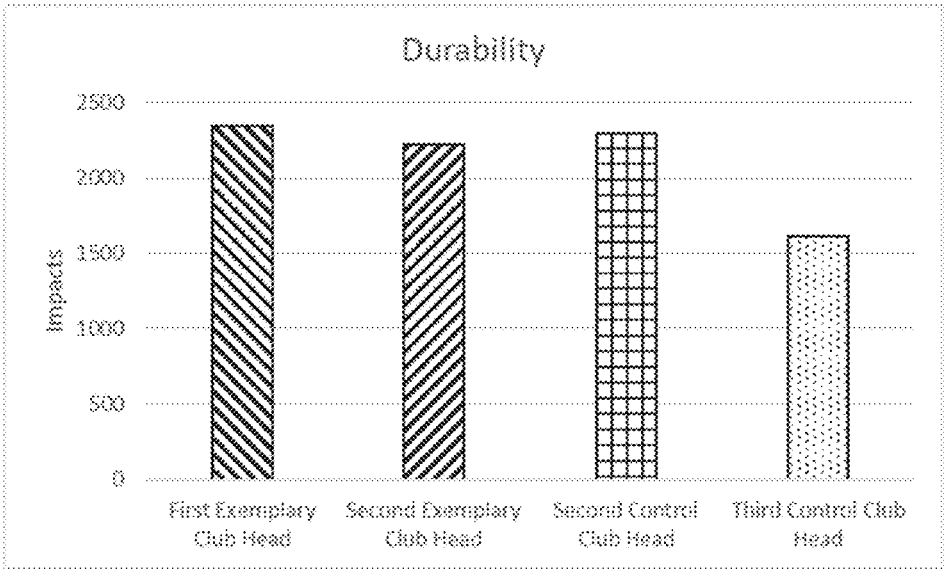
FIG. 15 illustrates a bar graph of durability that was observed in tests described in Examples 5 and 6.
Figure 16:
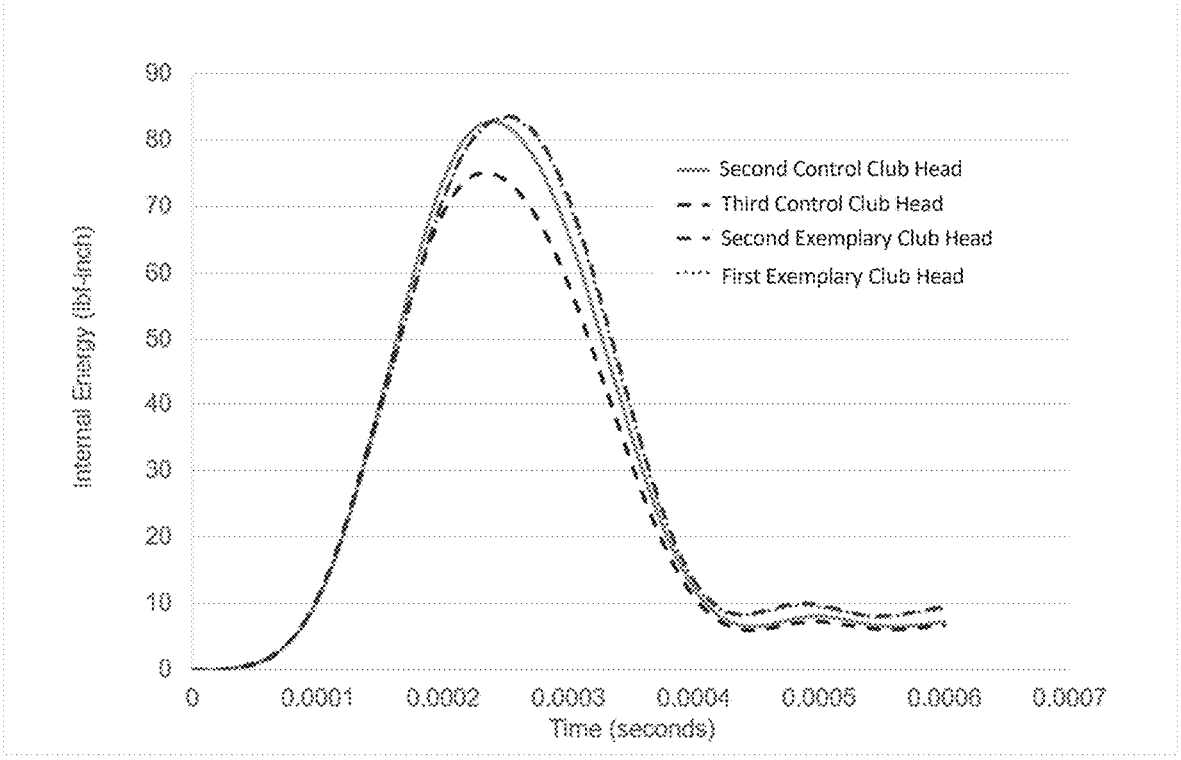
FIG. 16 illustrates a plot of the internal energy vs. time for exemplary and control club heads tested in certain examples described herein.

As visually displayed in the bar graph at FIG. 15, the first exemplary club head failed at 2346 golf ball impacts, while the second control club head failed at 2298 golf ball impacts. The curvilinear resilient member provided durability to the strike face region of the first exemplary club head. The fourth performance test proved the first exemplary club head comprising a curvilinear resilient member and thin face, maintained durability with respect to the second control club head.

Example 5

In a fifth performance test, durability was compared between the second exemplary club head and the second control club head. The fifth performance test consisted of a durability test wherein each club head was subjected to 2000 golf ball impacts at 120 MPH, 500 golf ball impacts at 130 MPH, 500 golf ball impacts at 140 MPH and 500 golf ball impacts at 150 MPH. The number of impacts was measured until failure of the golf club head.

As visually displayed in the bar graph at FIG. 15, the second exemplary club head failed at 2221 golf ball impacts. The second control club head failed at 2298 golf ball impacts. The curvilinear resilient member with an integral hinge proved to provide durability to the strike face region of the second exemplary club head. The fifth performance test proves the second exemplary club head comprising a curvilinear resilient member comprising an integral hinge and thin face, maintained durability with respect to the second control club head.

Example 6

In a sixth performance test, durability was compared among the first exemplary club head, the second exemplary club head, and the third control club head. The sixth performance test consisted of a durability test wherein each club head was subjected to 2000 golf ball impacts at 120 MPH, 500 golf ball impacts at 130 MPH, 500 golf ball impacts at 140 MPH and 500 golf ball impacts at 150 MPH. The number of impacts was measured until failure of the golf club head.

As visually displayed in the bar graph at FIG. 15, the first exemplary club head failed at 2346 golf ball impacts. The second exemplary club head failed at 2221 golf ball impacts.

The third control club head failed at 1617 golf ball impacts. The sixth performance test proved the first exemplary club head and the second exemplary club head was more durable than the third control club head.

Example 7

In a seventh performance test, internal energies resulting from impacts were compared between the first exemplary club head and the second control club head. The seventh performance test consisted of a golf ball impact simulation on the first exemplary club head and the second control club head. The simulation involved impacting the geometric center of the strike face of the club head with a golf ball-like object at 100 MPH. The first exemplary club head had an internal energy of 83.6 lbf-inch. The second control club head had an internal energy of 82.1 lbf-inch.

The first exemplary club head had more internal energy relative to the first control club head. The first exemplary club head had 1.5 lbf-inch more internal energy than the first control club head. The first exemplary club head internal energy increase will yield approximately a 0.25 to 4 MPH gain in ball speed (equating to 1-3 additional yards) relative to the second control club head.

Example 8

In an eighth performance test, internal energies resulting from impacts were compared between the second exemplary club head and the second control club head. The eighth performance test consisted of a golf ball impact simulation on the second exemplary club head and the second control club head. The simulation involved impacting the club head with a golf ball-like object at 100 MPH hitting the geometric center of the golf club head strike face. The second exemplary club head had an internal energy of 89.4 lbf-inch. The second control club head had an internal energy of 82.1 lbf-inch.

The second exemplary club head had more internal energy relative to the first control club head. The second exemplary club head had 7.3 lbf-inch more internal energy than the first control club head. The first exemplary club head internal energy increase will yield approximately a 0.25 to 4 MPH gain in ball speed (equating to 1-3 additional yards) relative to the second control club head.

The examples discussed above prove the use of a curvilinear resilient member or a curvilinear resilient member further comprising an integral hinge provide a gain in ball speed relative to an industry standard golf club head or a club head comprising a member devoid of curvature. The resilient members provide a golf club head that maintains durability while providing a gain in ball speed.

The invention claimed is:

1. A golf club head comprising:

a strike face comprising a striking surface for impacting a golf ball;

a body comprising a crown, a sole, a heel, a toe, and a rear end, wherein the strike face and body are coupled together to enclose an interior cavity; and a resilient member disposed in the interior cavity and extending between the crown and the sole;

wherein the resilient member is spaced rearwardly of the strike face by an offset distance from 0.5 inch to 1.0 inch;

wherein the resilient member comprises a first end, coupled to the crown, a second end, coupled to the sole, and an integral hinge therebetween;

the integral hinge comprises a first hinge leg and a second hinge leg that define an included angle from 10 degrees to 80 degrees;

wherein the resilient member comprises a substantially curvilinear shape; and wherein the resilient member is integrally formed with the body.

2. The golf club head of claim 1, wherein the resilient member is configured to flex between a rest state prior to impact with the golf ball, in which the resilient member defines a first chord length, and a deflected state after impact with the golf ball, in which the resilient member defines a second chord length that is greater than the first chord length.

3. The golf club head of claim 1, wherein the resilient member comprises a material selected from the group consisting of spring steel and titanium.

4. The golf club head of claim 1, wherein the resilient member comprises a radius of curvature between 3 inches and 10 inches.

5. The golf club head of claim 1, wherein the strike face comprises a face center, and the resilient member is positioned along a heel to toe direction such that the resilient member is aligned with the face center.

6. The golf club head of claim 1, wherein the strike face comprises a maximum face thickness of 0.124 inch and a minimum face thickness of 0.074 inch.

7. A golf club head comprising:

a strike face comprising a striking surface for impacting a golf ball;

a body comprising a crown, a sole, a heel, a toe, and a rear end, wherein the strike face and body are coupled together to enclose an interior cavity; and a resilient member disposed in the interior cavity and extending between the crown and the sole;

wherein the resilient member is spaced rearwardly of the strike face by an offset distance from 0.5 inch to 1.0 inch;

wherein the resilient member comprises a first end, coupled to the crown, a second end, coupled to the sole, and an integral hinge therebetween;

the integral hinge comprises a first hinge leg and a second hinge leg that define an included angle between 10 and 80 degrees;

wherein the resilient member comprises a substantially curvilinear shape; and wherein the resilient member is mechanically attached to the golf club head.

8. The golf club head of claim 7, wherein the resilient member is configured to flex between a rest state prior to impact with the golf ball, in which the resilient member defines a first chord length, and a deflected state after impact with the golf ball, in which the resilient member defines a second chord length that is greater than the first chord length.

9. The golf club head of claim 7, wherein the strike face comprises a maximum face thickness of 0.124 inch and a minimum face thickness of 0.074 inch.

10. The golf club head of claim 7, wherein the resilient member comprises a radius of curvature between 3 inches and 10 inches.

11. A golf club head, comprising:

a body comprising a crown, a sole, a heel, a toe, and a rear;

a strike face coupled to the body to define an interior cavity, the strike face comprising a striking surface for impacting a golf ball and defining a face center;

an x-axis extending horizontally through the face center in a direction from the heel to the toe;

a y-axis perpendicular to the x-axis and extending vertically through the face center in a direction from the sole to the crown;

a z-axis perpendicular to the x-axis and the y-axis, and extending horizontally through the face center in a direction from the strike face to the rear;

a resilient member disposed in the interior cavity and having a first end attached to the crown, a second end attached to the sole, and an integral hinge therebetween:

the integral hinge comprises a first hinge leg and a second hinge leg that define an included angle between 10 and 80 degrees;

wherein the resilient member is spaced rearwardly of the strike face by an offset distance from 0.5 inch to 1.0 inch; and the resilient member comprising a curvilinear shape, wherein the curvilinear shape, when viewed in an YZ-plane defined by the y-axis and the z-axis, is concave relative to the strike face.

12. The golf club head of claim 11, wherein the resilient member comprises:

a resilient member width measured along the x-axis;

a resilient member height measured along the y-axis; and a resilient member depth measured along the z-axis; and wherein the resilient member width is greater than the resilient member depth.

13. The golf club head of claim 11, wherein the resilient member is configured to flex between a rest state prior to impact with the golf ball, in which the resilient member defines a first chord length, and a deflected state after impact with the golf ball, in which the resilient member defines a second chord length that is greater than the first chord length.

14. The golf club head of claim 11, wherein the resilient member is positioned along a heel to toe direction such that the resilient member is aligned with the face center.

15. The golf club head of claim 11, wherein the resilient member comprises a radius of curvature between 3 inches and 10 inches.

16. The golf club head of claim 11, wherein a resilient member width is 0.1 to 0.45 inches, and a resilient member depth is 0.01 to 0.2 inches.

* * * * *